US011454917B2

(12) United States Patent
Yabe et al.

(10) Patent No.: US 11,454,917 B2
(45) Date of Patent: Sep. 27, 2022

(54) IMAGE FORMING APPARATUS

(71) Applicants: Kenji Yabe, Kanagawa (JP); Yuusuke Furuichi, Kanagawa (JP); Tomoya Adachi, Kanagawa (JP)

(72) Inventors: Kenji Yabe, Kanagawa (JP); Yuusuke Furuichi, Kanagawa (JP); Tomoya Adachi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/336,450

(22) Filed: Jun. 2, 2021

(65) Prior Publication Data

US 2021/0389713 A1 Dec. 16, 2021

(30) Foreign Application Priority Data

Jun. 16, 2020 (JP) ..... JP2020-103660
Sep. 23, 2020 (JP) ..... JP2020-158608

(51) Int. Cl.
*G03G 21/00* (2006.01)
*G03G 15/20* (2006.01)

(52) U.S. Cl.
CPC ..... *G03G 21/0094* (2013.01); *G03G 15/2053* (2013.01); *G03G 15/2064* (2013.01)

(58) Field of Classification Search
CPC ..... G03G 21/0094; G03G 15/2053; G03G 2215/2035; G03G 15/2064; G03G 15/2017; G03G 15/2042
See application file for complete search history.

(56) References Cited

U.S. PATENT DOCUMENTS

2009/0010693 A1* 1/2009 Hatori ..... G03G 21/1821 399/346
2011/0123239 A1* 5/2011 Azeyanagi ..... G03G 21/0094 399/346
2017/0205760 A1* 7/2017 Boettcher ..... G03G 21/0094
2017/0285555 A1* 10/2017 Hagimoto ..... F16N 15/00
(Continued)

FOREIGN PATENT DOCUMENTS

JP 2006-091037 4/2006
JP 2010-072564 4/2010
(Continued)

*Primary Examiner* — Jessica L Eley
(74) *Attorney, Agent, or Firm* — Harness, Dickey & Pierce, P.L.C.

(57) ABSTRACT

An image forming apparatus includes an image bearer, a protectant applicator, a heating device, and a protectant biasing member. The protectant applicator applies protectant to the image bearer. The heating device includes a heater including a base, a heat generator, an electrode, and a conductor coupling the heat generator to the electrode. The heater has a first position and a second position having a higher temperature than the first position. These are symmetrical to each other with respect to a longitudinal center of a heat generation area of the heater. The protectant biasing member biases the protectant to the protectant applicator with a first biasing force at a position closer to the first position than to the second position and with a second biasing force larger than the first biasing force at a position closer to the second position than to the first, and the protectant contacts the protectant applicator.

14 Claims, 16 Drawing Sheets

(56) References Cited

U.S. PATENT DOCUMENTS

| | | | | |
|---|---|---|---|---|
| 2018/0328535 | A1* | 11/2018 | Azuma | F16N 15/00 |
| 2019/0146388 | A1* | 5/2019 | Kawasaki | H05B 3/0095 399/331 |
| 2019/0286027 | A1 | 9/2019 | Someya et al. | |
| 2020/0033766 | A1 | 1/2020 | Hase et al. | |
| 2020/0033767 | A1 | 1/2020 | Adachi et al. | |
| 2020/0103796 | A1 | 4/2020 | Furuichi et al. | |
| 2020/0103803 | A1 | 4/2020 | Furuichi | |
| 2020/0174407 | A1 | 6/2020 | Furuichi | |
| 2020/0174408 | A1 | 6/2020 | Furuichi et al. | |
| 2020/0379384 | A1 | 12/2020 | Samei et al. | |
| 2020/0387096 | A1 | 12/2020 | Adachi et al. | |
| 2020/0401067 | A1 | 12/2020 | Samei et al. | |
| 2021/0041810 | A1 | 2/2021 | Furuichi | |
| 2021/0041832 | A1 | 2/2021 | Furuichi | |
| 2021/0157259 | A1 | 5/2021 | Inoue et al. | |

FOREIGN PATENT DOCUMENTS

| | | |
|---|---|---|
| JP | 2016-062024 | 4/2016 |
| JP | 2019-091003 | 6/2019 |

* cited by examiner

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3600 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | — |
| TOTAL HEAT GENERATION AMOUNT | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | | 6400 | 3600 | 1600 | 400 | — | |
| HEAT GENERATION AMOUNT OF SECOND POWER SUPPLY LINE 62B | | 25 | 225 | 1225 | 3025 | 5625 | |
| HEAT GENERATION AMOUNT OF FOURTH POWER SUPPLY LINE 62D | | 25 | 25 | 25 | 25 | 25 | |
| TOTAL HEAT GENERATION AMOUNT | | 6450 | 3850 | 2850 | 3450 | 5650 | |

| | POSITION α2 NEAR THE OTHER END e2 | CENTER c | POSITION α1 NEAR ONE END e1 |
|---|---|---|---|
| HEAT GENERATION AMOUNT OF FIRST POWER SUPPLY LINE 62A | 8100 | 2500 | 100 |
| HEAT GENERATION AMOUNT OF SECOND POWER SUPPLY LINE 62B | 8100 | 2500 | 100 |
| TOTAL HEAT GENERATION AMOUNT | 16200 | 5000 | 200 |

IMAGE FORMING APPARATUS

CROSS-REFERENCE TO RELATED APPLICATIONS

This patent application is based on and claims priority pursuant to 35 U.S.C. § 119(a) to Japanese Patent Applications No, 2020-103660, filed on Jun. 16, 2020, and No. 2020-158608, filed on Sep. 23, 2020 in the Japan Patent Office, the entire disclosure of each of which is incorporated by reference herein.

BACKGROUND

Technical Field

Embodiments of the present disclosure generally relate to an image forming apparatus.

Related Art

As image forming apparatuses such as copiers and printers, an electrophotographic image forming apparatus is known. The electrophotographic image forming apparatus uses toner to form a toner image.

In general, the electrophotographic image forming apparatus includes a fixing device that fixes the toner image onto a sheet. The fixing device includes a heating member such as a heater that heats the sheet. When the sheet passes through the fixing device, the heating member heats the sheet, so that the toner on the sheet is melted and fixed to the sheet.

SUMMARY

This specification describes an improved image forming apparatus that includes an image bearer, a protectant applicator, a heating device, and a protectant biasing member. The image bearer is configured to bear an image on a surface of the image bearer. The protectant applicator is configured to apply protectant to the surface of the image bearer. The heating device includes a heater that includes a base, a heat generator, an electrode, and a conductor coupling the heat generator to the electrode. The heater is configured to have a first position and a second position having a higher temperature than the first position. The first position and the second position are symmetrical to each other with respect to a longitudinal center of a heat generation area of the heater. The protectant biasing member is configured to bias the protectant to the protectant applicator with a first biasing force at a position closer to the first position than to the second position and with a second biasing force which is larger than the first biasing force at a position closer to the second position than to the first position such that the protectant contacts the protectant applicator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
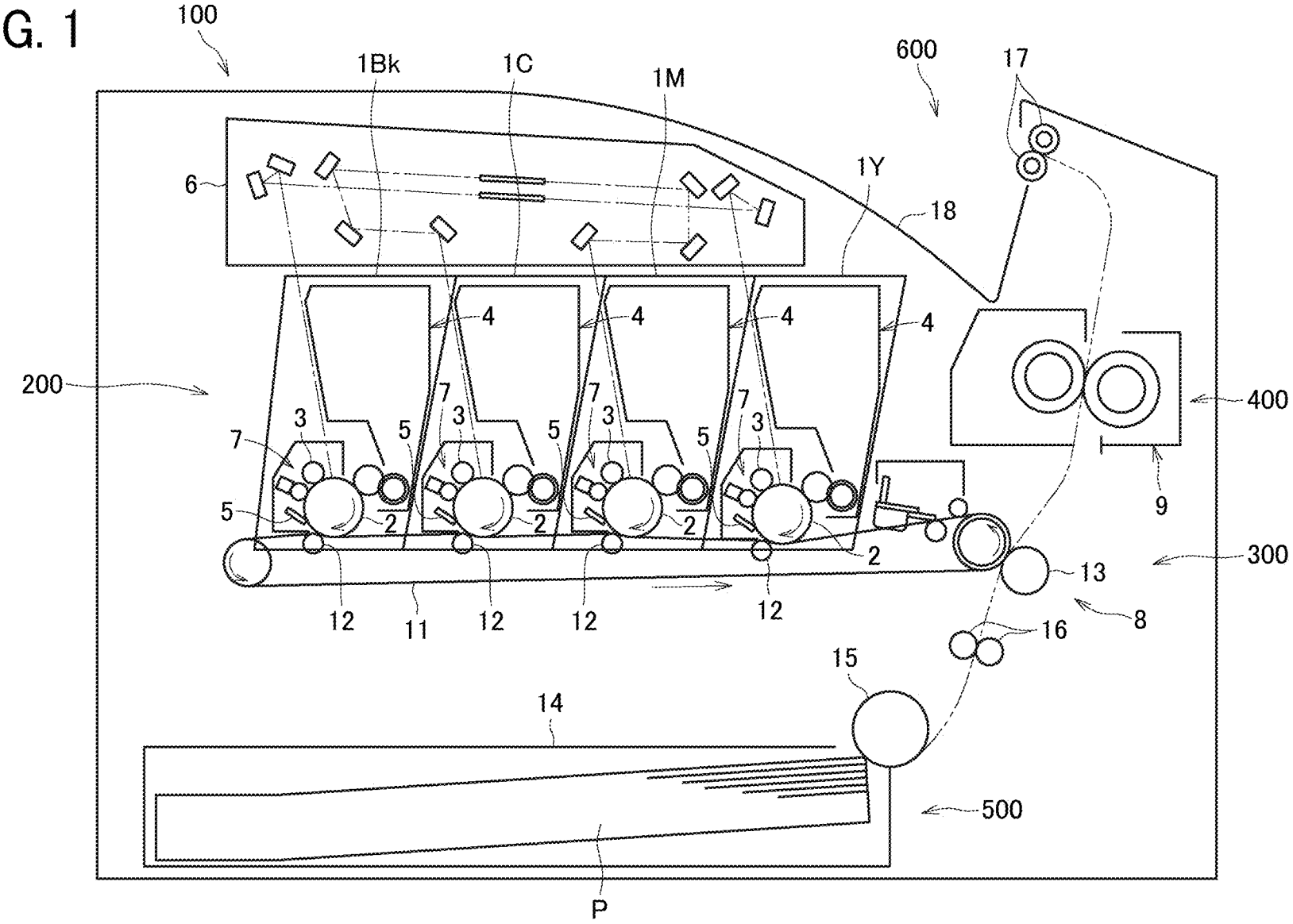
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

The following is a description of the present disclosure with reference to attached drawings. In the drawings for explaining the present disclosure, identical reference numerals are assigned to elements such as members and parts that have an identical function or an identical shape as long as differentiation is possible, and a description of those elements is omitted once the description is provided.

FIG. 1 is a schematic view illustrating a configuration of an image forming apparatus according to an embodiment of the present disclosure.

The image forming apparatus 100 illustrated in FIG. 1 includes an image forming section 200, a transfer section 300, a fixing section 400, a recording medium supply section 500, and a recording medium ejection section 600.

The image forming section 200 includes four image forming units 1Y, 1M, 1C, and 1Bk and an exposure device 6. Each of the four image forming units 1Y, 1M, 1C, and 1Bk is removably installed in the body of the image forming apparatus 100. The image forming units 1Y, 1M, 1C, and 1Bk have the same configuration except fix containing different color developers, i.e., yellow (Y), magenta (M), cyan (C), and black (Bk) toners, respectively, corresponding to decomposed color separation components of full-color images. Specifically, each of the image forming units 1Y, 1M, 1C, and 1Bk includes a photoconductor 2 as an image bearer to bear an image on the surface of the image bearer, a charging roller 3 as a charging device to charge the surface of the photoconductor 2, a developing device 4 to form a toner image on the surface of the photoconductor 2, a cleaning blade 5 as a cleaning device to clean the surface of the photoconductor 2, and a protectant supply device 7 to supply image bearer protectant to the surface of the photoconductor 2. The exposure device 6 serving as a latent image forming device exposes the surface of the photoconductor 2 charged the charging roller 3 to light based on image data to form an electrostatic latent image on the photoconductor 2.

The transfer section 300 includes a transfer device 8 that transfers the toner image to a sheet as a recording medium. The recording medium on which the toner image is transferred and formed may be paper (including plain paper, thick paper, thin paper, coated paper, label paper, and envelopes) or a resin sheet such as an overhead projector (OHP) transparency. The transfer device 8 includes an intermediate transfer belt 11, four primary transfer rollers 12, and a secondary transfer roller 13. The intermediate transfer belt 11 is a transfer member that bears the toner image on the surface of the intermediate transfer belt 11 and transfers the toner image to the sheet. The intermediate transfer belt 11 is an endless belt. The four primary transfer rollers 12 are in contact with four photoconductors 2 via the intermediate transfer belt 11, respectively. As a result, a primary transfer nip is formed between the intermediate transfer belt 11 and each of the photoconductors 2. At the primary transfer nip, each of the photoconductors 2 is in contact with the intermediate transfer belt 11. The secondary transfer roller 13 is in contact with one of a plurality of rollers around which the intermediate transfer belt 11 is stretched via the intermediate transfer belt 11 to form a secondary transfer nip with the intermediate transfer belt 11.

The fixing section 400 includes a fixing device 9 that is a heating device to heat the sheet. The fixing device 9 heats the sheet to fix the toner image onto the sheet.

The recording medium supply section 500 includes a sheet tray 14 to store sheets P and a feed roller 15 to feed the sheet P from the sheet tray 14.

The recording medium ejection section 600 includes an ejection roller pair 17 to eject the sheet to the outside of the image forming apparatus and an output tray 18 on which the sheet ejected by the ejection roller pair 17 is placed.

Next, a printing operation of the image forming apparatus 100 according to the present embodiment is described with reference to FIG. 1.

After the image forming apparatus 100 receives an instruction to start a print operation, the photoconductors 2 of the image forming units 1Y, 1M, 1C, and 1Bk and the intermediate transfer belt 11 start rotating. The feed roller 15 rotates to feed the sheet P from the sheet tray 14. The sheet P fed from the sheet tray 14 is brought into contact with the timing roller pair 16 and temporarily stopped.

Firstly, in each of the image forming units 1Y, 1M, 1C, and 1Bk, the charging roller 3 uniformly charges the surface of the photoconductor 2 to a high potential. Next, the exposure device 6 exposes the surface (that is, the charged surface) of each photoconductor based on image data of a document read by a document reading device or print image data sent from a terminal that sends a print instruction. As a result, the potential of the exposed portion on the surface of each photoconductor 2 decreases, and an electrostatic latent image is formed on the surface of each photoconductor 2. The developing device 4 supplies toner to the electrostatic latent image formed on the photoconductor 2, forming the toner image thereon. When the toner images formed on the photoconductors 2 reach the primary transfer nips defined by the primary transfer rollers 12 with the rotation of the photoconductors 2, the toner images formed on the photoconductors 2 are transferred onto the intermediate transfer belt 11 rotated counterclockwise in FIG. 1 successively such that the toner images are superimposed on the intermediate transfer belt 11, forming a full color toner image thereon. Thus, the full color toner image is formed on the intermediate transfer belt 11. After the toner image is transferred from the photoconductor 2 onto the intermediate transfer belt 11, the cleaning blade 5 removes residual toner and other foreign substances that are remained on the photoconductor 2 from the surface of the photoconductor 2. Further, the protectant supply device 7 supplies a lubricant that is protectant for the image bearer to the surface of each photoconductor 2 cleaned by the cleaning blade 5, and the photoconductor 2 is prepared for a next electrostatic latent image formation.

In accordance with rotation of the intermediate transfer belt 11, the full color toner image transferred onto the intermediate transfer belt 11 reaches the secondary transfer nip at the secondary transfer roller 13 and is transferred onto the sheet P conveyed by the timing roller pair 16 at the secondary transfer nip. The sheet P transferred with the full color toner image is conveyed to the fixing device 9 that fixes the full color toner image on the sheet P. Thereafter, the sheet P is conveyed and ejected to the output tray 18 by the ejection roller pair 17. Thus, a series of image forming operations is completed.

The above description refers to an image forming operation for forming the full color toner image on the sheet. The image forming apparatus is also capable of forming a single-color image by operating only one of the four image forming units, or a two-color or three-color image by operating two or three of the four image forming units, respectively.

Figure 2:
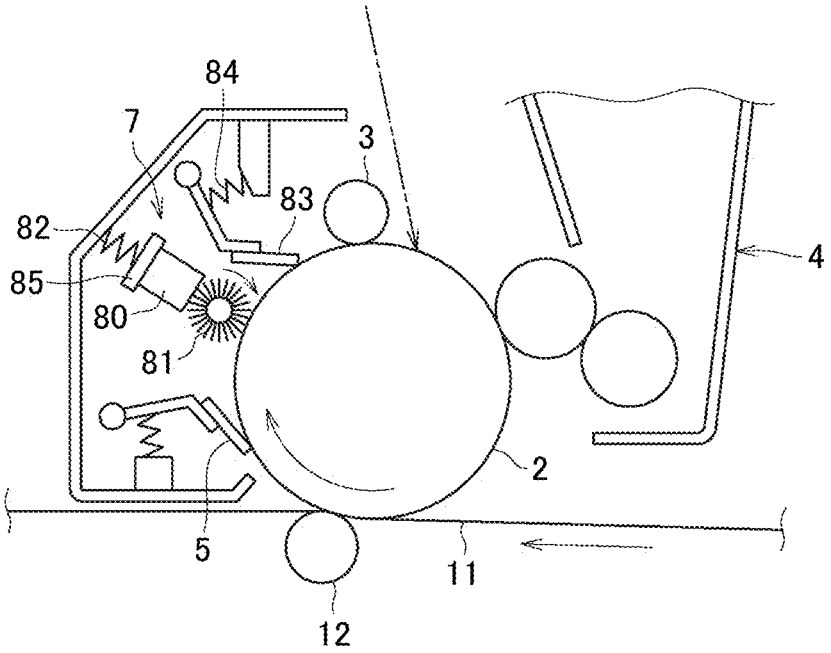
FIG. 2 is a schematic view illustrating a configuration of a protectant supply device according to an embodiment of the present disclosure.

FIG. 2 is a schematic view illustrating a configuration of the protectant supply device 7 according to the present embodiment.

As illustrated in FIG. 2, the protectant supply device 7 according to the present embodiment includes lubricant 80 as the protectant for the image bearer, a brush roller 81 as a lubricant applicator that is a protectant applicator to apply the lubricant 80 to the photoconductor 2, a lubricant holder 85 as a lubricant holder that is a protectant holder to hold the lubricant 80, a spring 82 as a lubricant biasing member that is a protectant biasing member to push the lubricant 80 against the brush roller 81 via the lubricant holder 85, a coating blade 83 as a layering member that uniformly layers the lubricant 80 applied to the photoconductor 2 and forms a uniform thin layer on the photoconductor 2, and a spring 84 as a layering member biasing member that pushes the coating blade 83 so that the coating blade 83 is in contact with the photoconductor 2.

The brush roller 81 is in contact with the surface of the photoconductor 2 and rotates in a direction opposite to the rotation direction of the photoconductor 2. The brush roller 81 rotates to scrape the lubricant 80. The brush roller 81 applies the scraped lubricant 80 to the surface of the photoconductor 2. The lubricant 80 applied to the surface of the photoconductor 2 is layered to form a uniform thin layer of the lubricant 80 on the photoconductor 2. The lubricant 80, the brush roller 81, and the coating blade 83 extend over a range equal to or larger than a maximum image formation area on the photoconductor 2.

Forming the thin layer of the lubricant 80 on the surface of the photoconductor 2 as described above improves a cleaning performance of the cleaning blade 5 to clean the photoconductor 2 and prevents an occurrence of an abnormal image caused by a cleaning failure. The lubricant applicator may be a urethane roller made of foamed polyurethane or the like in addition to the brush roller 81.

The lubricant 80 is formed by compressing powder containing at least a fatty acid metal salt and an inorganic lubricant, for example.

The fatty acid metal salt of the lubricant 80 may be, for example, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, capper oleate, lead oleate, manganese oleate, zinc palmitate, cobalt palmitate, lead palmitate, magnesium palmitate, aluminum palmitate, calcium palmitate, lead octanoate, lead caprylate, zinc linolenic acid, cobalt linolenic acid, calcium linolenic acid, zinc ricinoleate, cadmium ricinoleate, and theses mixture but not limited to this. Two or more of materials above may be mixed and used.

The inorganic lubricant of the lubricant 80 means an inorganic compound which exhibits lubricating properties by being cleft or in which an internal slide occurs. Examples of the inorganic compound includes mica, boron nitride, molybdenum disulphide, tungsten disulphide, talc, kaolin, montmorillonite, calcium fluoride, and graphite. However, the examples are not limited to these. For example, boron nitride is a substance in which hexagonal lattice planes formed by firmly bonded atoms are stacked on top of one another with sufficient space between each and thus weak van der Waals force is the only force which acts between layers; therefore, the layers are easily separated from one another and lubricating properties are exhibited.

Next, a description is given of the configuration of the fixing device 9 according to the present embodiment.

Figure 3:
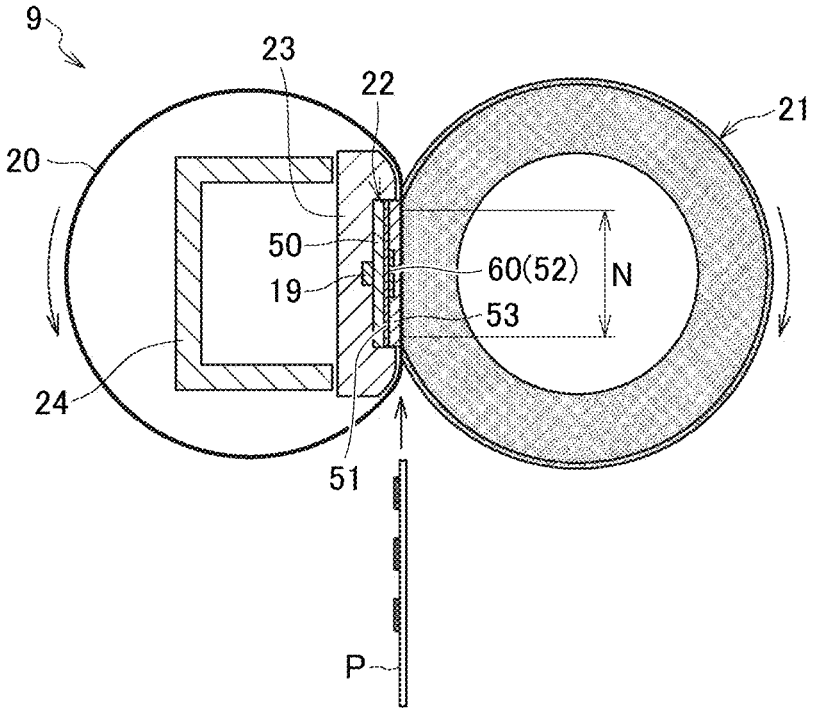
FIG. 3 is a schematic view of a fixing device incorporated in the image forming apparatus of FIG. 1.

As illustrated in FIG. 3, the fixing device 9 according to the present embodiment includes a fixing belt 20, a pressure roller 21, a heater 22, a heater holder 23, a stay 24, and a temperature sensor 19.

The fixing belt 20 is a fixing member to fix an unfixed toner image on the sheet P. The fixing belt 20 is disposed facing on an image bearing side of the sheet P on which the unfixed toner image is held, that is, facing the surface of the sheet P on which the toner image is formed. The fixing belt 20 is referred to as a first rotator. The fixing belt 20 is, for example, an endless belt including a tubular base having an outer diameter of 25 mm and a thickness of from 40 to 120 μm. The base of the fixing belt 20 may be made of heat-resistant resin such as polyetheretherketone (PEEK) or metal such as nickel (Ni) or stainless steel (Stainless Used Steel, SUS), in addition to polyimide. A release layer made of fluoroplastic such as perfluoroalkoxy alkane (PFA) or polytetrafluoroethylene (PTFE) may coat an outer circumferential surface of the base to facilitate separation of foreign substances from the fixing belt 20 and improve the durability of the fixing belt 20. An elastic layer made of rubber or the like may be interposed between the base and the release layer. Additionally, a sliding layer made of polyimide, polytetrafluoroethylene (TFE), or the like may be provided on the inner circumferential surface of the base.

The pressure roller 21 is a rotatable opposite member disposed opposite an outer circumferential surface of the fixing belt 20. The pressure roller 21 is referred to as a second rotator different from the first rotator that is the fixing belt 20. The pressure roller 21 is also a pressing member that is pressed against the outer circumferential surface of the fixing belt 20 to form a nip N between the pressure roller 21 and the fixing belt 20. The pressure roller 21 has, for example, an outer diameter of 25 mm and includes a core made of iron, an elastic layer made of silicone rubber and disposed on the outer circumferential surface of the core, and a release layer made of fluororesin and disposed on the outer circumferential surface of the elastic layer.

The heater 22 is a heating member that comes into contact with the inner circumferential surface of the fixing belt 20 and heats the fixing belt 20 from the inside. In the present embodiment, the heater 22 includes a planar base 50, a first insulation layer 51 disposed on the base 50, a conductor layer 52 disposed on the first insulation layer 51, and a second insulation layer 53 that covers the conductor layer 52. The conductor layer 52 includes a heat generator 60.

The base 50 is made of a metal material such as stainless steel (SUS), iron, or aluminum. The base 50 may be made of ceramic, glass, etc. instead of metal. If the base 50 is made of an insulating material such as ceramic, the first insulation layer 51 sandwiched between the base 50 and the conductor layer 52 may be omitted. Since metal has an enhanced durability against rapid heating and is processed readily, metal is preferably used to reduce manufacturing costs. Among metals, aluminum and copper are preferable because aluminum and copper have high thermal conductivity and are less likely to cause uneven temperature. Stainless steel is advantageous because stainless steel is manufactured at reduced costs compared to aluminum and copper.

The first insulation layer 51 and the second insulation layer 53 are made of material having electrical insulation, such as heat-resistant glass. Alternatively, each of the first insulation layer 51 and the second insulation layer 53 may be made of ceramic, polyimide (PI), or the like. In addition, another insulation layer may be disposed on one surface of the base 50 opposite to the other surface on which the first insulation layer 51 and the second insulation layer 53 are disposed.

Although the heat generator 60 is disposed on the front side of the base 50 near the nip N in the present embodiment, alternatively, the heat generator 60 may be disposed on the back side of the base 50. In this case, since the heat of the heat generator 60 is transmitted to the fixing belt 20 through the base 50, it is preferable that the base 50 be made of a material with high thermal conductivity such as aluminum nitride.

In the present embodiment, the heater 22 directly contacts the inner circumferential surface of the fixing belt 20 to efficiently conduct heat from the heater 22 to the fixing belt 20. However, the present disclosure is not limited to this. The heater 22 may not contact the fixing belt 20 or may contact the fixing belt 20 indirectly via, e.g., a low friction sheet. The heater 22 may contact the outer circumferential surface of the fixing belt 20. The heater 22 contacting the inner circumferential surface of the fixing belt 20 as in the present embodiment has an advantage that the heater 22 can avoid deterioration of fixing quality because the heater 22 does not damage the outer circumferential surface of the fixing belt 20.

The heater holder 23 is disposed inside the loop of the fixing belt 20 to hold the heater 22 contacting the inner circumferential surface of the fixing belt 20. Since the heater holder 23 is subject to temperature increase by heat from the heater 22, the heater holder 23 is preferably made of a heat-resistant material. When the heater holder 23 is made of heat-resistant resin having low thermal conduction, such as a liquid crystal polymer (LCP) or polyether ether ketone (PEEK), the heater holder 23 can have a heat-resistant property and reduce heat transfer from the heater 22 to the heater holder 23. Therefore, the heater 22 can efficiently heats the fixing belt 20.

The stay 24 is a reinforcing member disposed inside the loop of the fixing belt 20. The stay 24 supports a stay side face of the heater holder 23. The stay side face is opposite a nip side face of the heater holder 23. Accordingly, the stay 24 prevents the heater holder 23 from being bended by a pressing force of the pressure roller 21. Thus, the fixing nip N is formed between the fixing belt 20 and the pressure roller 21 to be a uniform width. The stay 24 is preferably made of an iron-based metal such as stainless steel (SUS) or steel electrolytic cold commercial (SECC) that is electrogalvanized sheet steel to ensure rigidity.

The temperature sensor 19 is a temperature detector that detects the temperature of the heater 22. Based on detection results of the temperature sensor 19, output of the heater 22 is controlled so that the temperature of the fixing belt 20 is maintained to be a desired temperature that is a fixing temperature. The temperature sensor 19 may be either contact type or non-contact type. For example, the temperature sensor 19 may be a known temperature sensor such as a thermopile, a thermostat, a thermistor, or a non-contact (NC) sensor.

In the fixing device 9 according to the present embodiment, power is supplied to the heater 22 in response to a start of a print job. The power causes the heat generator 60 to generate heat, thus heating the fixing belt 20. A driver drives and rotates the pressure roller 21, and the fixing belt 20 starts rotating with the rotation of the pressure roller 21. When the temperature of the fixing belt 20 reaches a predetermined target temperature called a fixing temperature, as illustrated in FIG. 3, the sheet P bearing an unfixed toner image enters the nip N between the fixing belt 20 and the pressure roller 21 and is conveyed by the fixing belt 20 and the pressure roller 21, and the unfixed toner image is heated and pressed onto the sheet P and fixed thereon.

Figure 4:
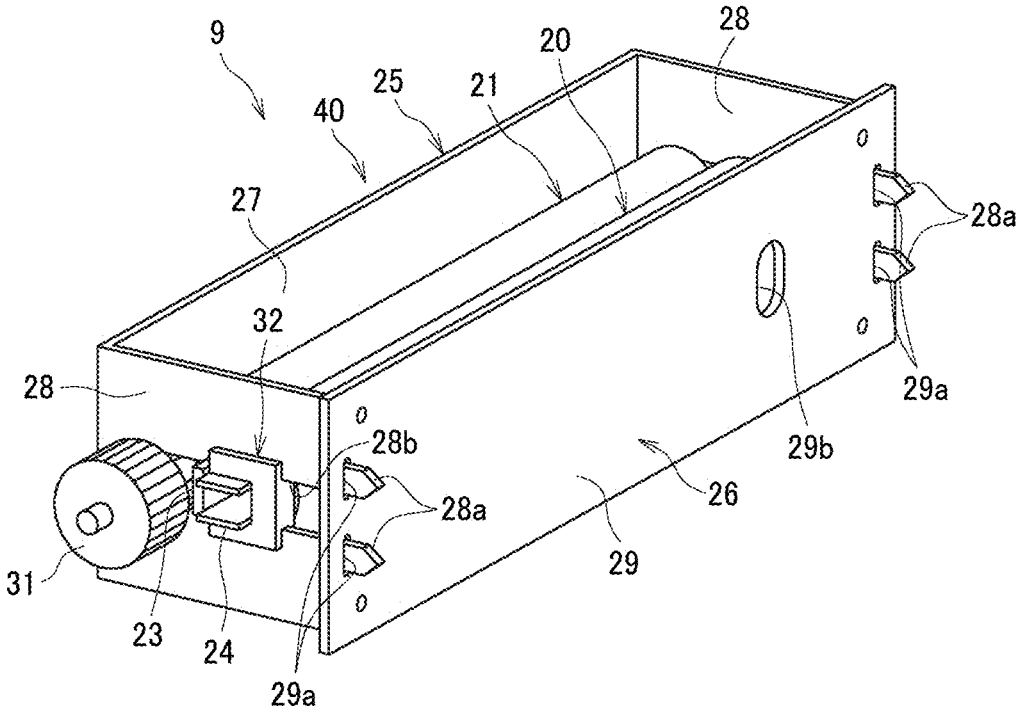
FIG. 4 is a perspective view of the fixing device depicted in FIG. 3.
Figure 5:
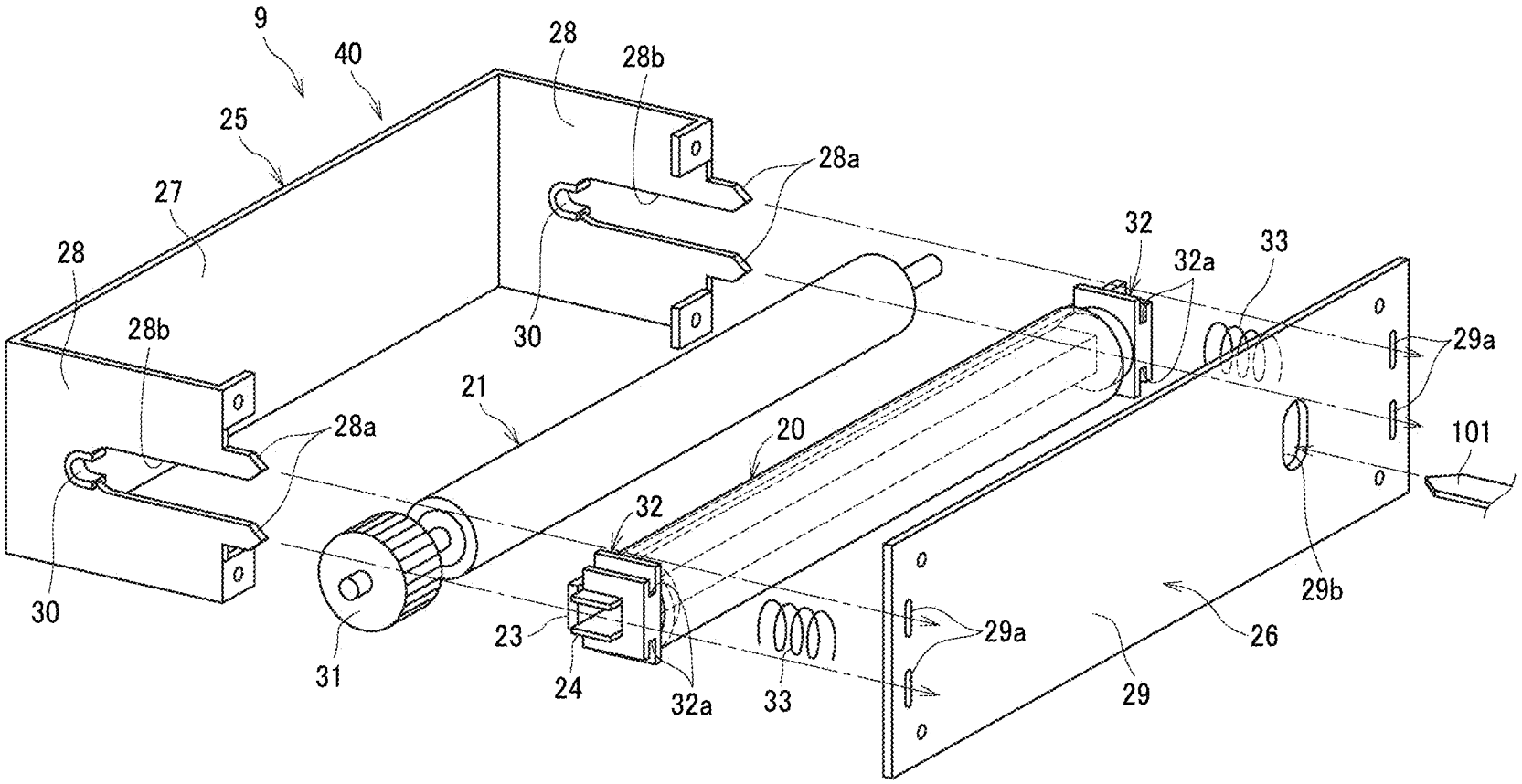
FIG. 5 is an exploded perspective view of the fixing device depicted in FIG. 3.

FIG. 4 is a perspective view of the fixing device 9 according to the present embodiment. FIG. 5 is an exploded perspective view of the fixing device 9.

As illustrated in FIGS. 4 and 5, the fixing device 9 according to the present embodiment includes a frame 40 having a rectangular shape. The frame 40 includes a first frame 25 and a second frame 26. The first frame 25 includes a front wall 27 and a pair of side walls 28 that are configured as one part. The second frame 26 includes a rear wall 29. Each of the pair of side walls 28 includes a plurality of engaging projections 28*a*. As the engaging projections 28 engage corresponding engaging holes 29*a* in the rear wall 29, the first frame 25 is coupled to the second frame 26.

The pair of side walls 28 support the fixing belt 20 and the pressure roller 21. To support the fixing belt 20 and the pressure roller 21, each of the side walls 28 has a slot 28*b* through which a rotation shaft of the pressure roller 21 and the like are inserted. The slot 28*b* opens toward the rear wall 29 and closes at a portion opposite the rear wall 29, and the portion of the slot 28*b* opposite the rear wall 29 serves as a contact portion. A bearing 30 that rotatably supports the rotation shaft of the pressure roller 21 is disposed on the contact portion. A drive transmission gear 31 serving as a driving force transmitter is disposed at one end of a rotation shaft of the pressure roller 21 in an axial direction thereof. In a state in which the side walls 28 support the pressure roller 21, the drive transmission gear 31 is exposed outside the side wall 28. Accordingly, when the fixing device 9 is installed in the body of the image forming apparatus 100, the drive transmission gear 31 is coupled to a gear disposed in the body of the image forming apparatus 100 so that the drive transmission gear 31 transmits the driving force from the driver to the pressure roller 21. Alternatively, the driving force transmitter to transmit the driving force to the pressure roller 21 may be pulleys over which a driving force transmission belt is stretched taut, a coupler, and the like instead of the drive transmission gear 31.

A pair of supports 32 is disposed at both lateral ends of the fixing belt 20 in a longitudinal direction thereof, respectively to support the fixing belt 20 and the stay 24. Each support 32 has guide grooves 32*a*. As illustrated in FIG. 5, the pair of supports 32, the fixing belt 20, the stay 24, the heater holder 23, and the heater 22 are assembled to form a heating unit. Edges of the slot 28*b* in each of the side walls 28 enter into the guide grooves 32*a* of each of the supports 32 and slide on the guide grooves 32*a* to set the supports 32 in the side walls 28. As a result, side walls 28 support the fixing belt 20, the stay 24, the heater holder 23, and the heater 22. The pair of springs 33 as a biasing member is disposed between the supports 32 and the rear wall 29 and push the supports 32 to push the fixing belt 20 toward the pressure roller 21 and form the nip N.

As illustrated in FIGS. 4 and 5, the rear wall 29 includes a hole 29*b* as a positioner to position the body of the fixing device 9 with respect to the body of the image forming apparatus 100. As illustrated in FIG. 5, the body of the image forming apparatus 100 includes a projection 101 as a positioner. The projection 101 is inserted into the hole 29*b* of the fixing device 9. Accordingly, the projection 101 engages the hole 29*b*, positioning the body of the fixing device 9 with respect to the body of the image forming apparatus 100. Preferably, a position of the hole 29*b* is closer to one of the ends of the rear wall 29 than the center of the rear wall 29 in the longitudinal direction of the rear wall 29. The above-described position of the hole 29*b* allows expansion and contraction in the longitudinal direction due to temperature change on the end of the rear wall 29 not having the hole 29*b* and can reduce distortion of the frame 40.

Figure 6:
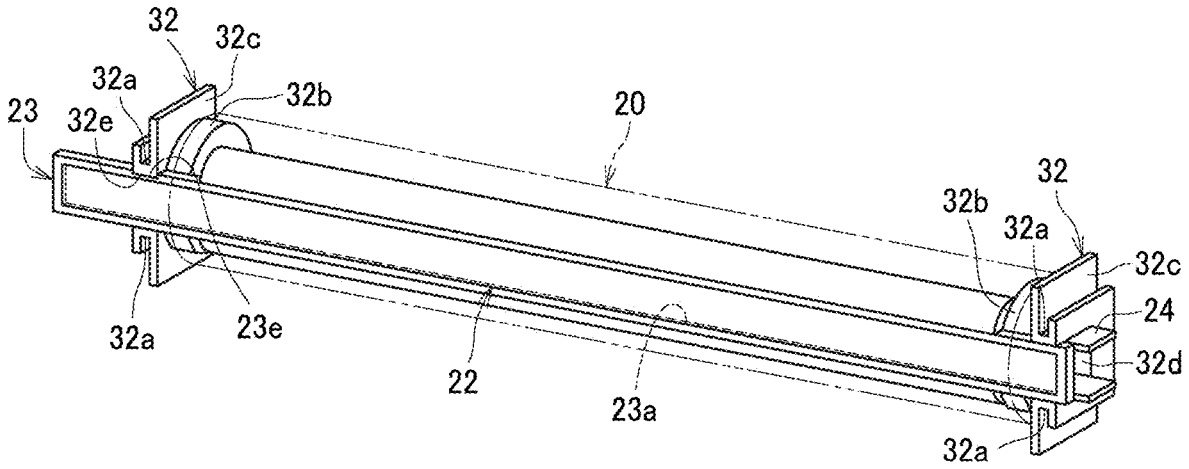
FIG. 6 is a perspective view of a heating unit incorporated in the fixing device depicted in FIG. 3.
Figure 7:
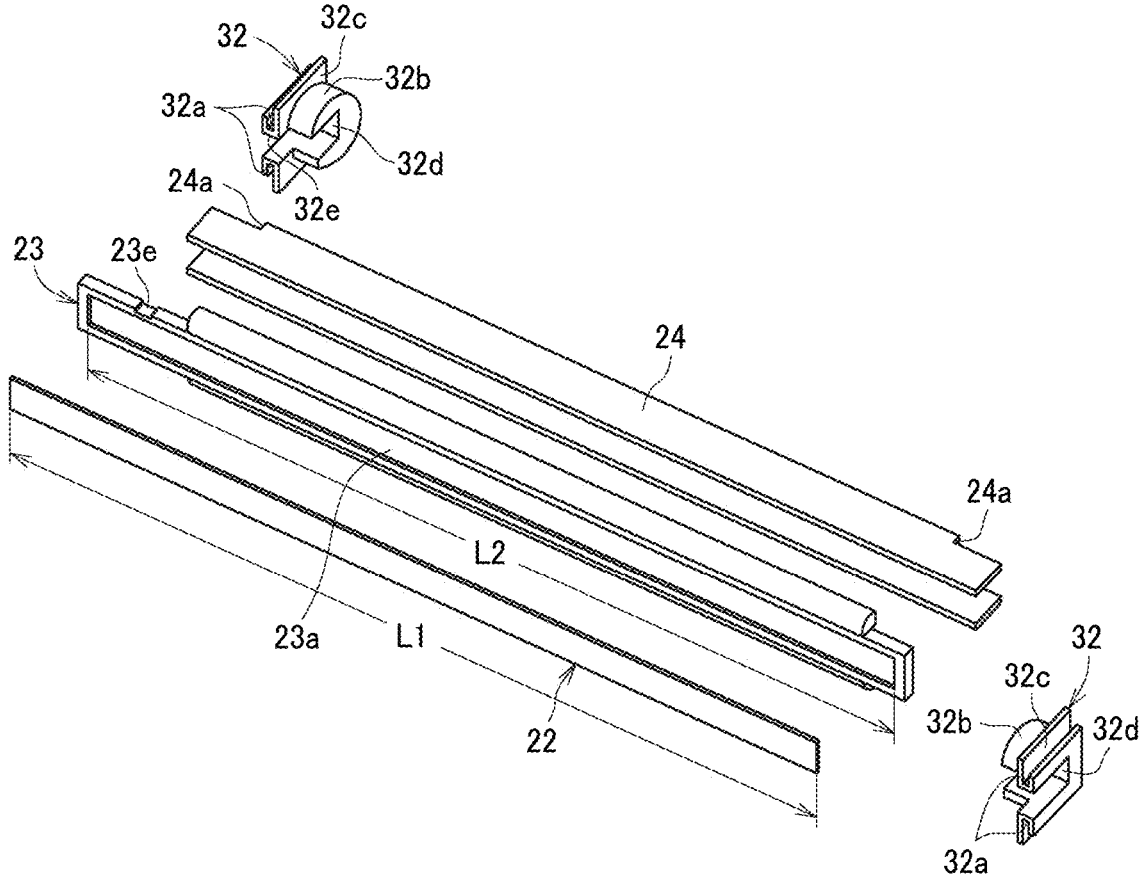
FIG. 7 is an exploded perspective view of the heating unit depicted in FIG. 6.

FIG. 6 is a perspective view of the heating unit in which the pair of supports 32 supports the heater 22 and other parts. FIG. 7 is an exploded perspective view of the heating unit.

As illustrated in FIG. 6, the heater 22 and the heater holder 23 are elongated members extending in a lateral direction in FIG. 6. The heater 22 and the heater holder 23 are disposed in the fixing device 9 so that the longitudinal directions of the heater 22 and the heater holder 23 are parallel to the longitudinal direction of the fixing belt 20 or the axial direction of the pressure roller 21. Similarly, the stay 24 is also disposed in the fixing device 9 so that the longitudinal direction of the stay 24 is parallel to the longitudinal direction of the fixing belt 20 or the axial direction of the pressure roller 21.

As illustrated in FIGS. 6 and 7, the heater holder 23 includes an accommodating recess 23*a* that is rectangular and accommodates the heater 22. The accommodating recess 23*a* has substantially the same shape and size as the shape and size of the heater 22. Specifically, however, a length L2 of the accommodating recess 23*a* in the longitudinal direction of the heater holder 23 is slightly longer than a length L1 of the heater 22 in the longitudinal direction of the heater 22. The accommodating recess 23*a* formed as described above enables avoiding an interference between the heater 22 and the accommodating recess 23*a* even when the heater 22 expands in the longitudinal direction due to thermal expansion.

In addition to the guide grooves 32*a* described above, each of the pair of supports 32 includes a belt support 32*b*, a belt restrictor 32*c*, and a supporting recess 32*d*. The belt support 32*b* is C-shaped and inserted into the loop of the fixing belt 20, thus contacting the inner circumferential surface of the fixing belt 20 to support the fixing belt 20. The belt restrictor 32*c* is a flange that contacts an edge face of the fixing belt 20 to restrict motion (e.g., skew) of the fixing belt 20 in the longitudinal direction of the fixing belt 20. One of both end portions of the heater holder 23 in the longitudinal direction thereof and one of both end portions of the stay 24 in the longitudinal direction thereof are inserted into the supporting recess 32*d*. As a result, the supporting recesses 32*d* support the heater holder 23 and the stay 24. As the belt support 32*b* is inserted into the loop formed by the fixing belt 20 on each end of the fixing belt 20 in the longitudinal direction of the fixing belt 20, the fixing belt 20 is supported by a free belt system in which the fixing belt 20 is not stretched basically in a circumferential direction of the fixing belt 20, which is a rotation direction of the fixing belt 20, while the fixing belt 20 does not rotate.

As illustrated in FIGS. 6 and 7, the heater holder 23 includes a positioning recess 23*e* as a positioner disposed at one side of the heater holder 23 and away from the center of the heater holder 23 in the longitudinal direction thereof. The support 32 includes an engagement 32*e* illustrated in a left part in FIGS. 6 and 7. The engagement 32*e* engages the positioning recess 23*e*, positioning the heater holder 23 with respect to the support 32. The support 32 illustrated in a right part in FIGS. 6 and 7 does not include the engagement 32*e* and therefore the heater holder 23 is not positioned with respect to the support 32. Positioning the heater holder 23 with respect to the support 32 at one side of the heater holder 23 in the longitudinal direction of the heater holder 23 allows an expansion and contraction of the heater holder 23 in the longitudinal direction of the heater holder 23 due to a temperature change.

As illustrated in FIG. 7, the stay 24 includes step portions 24*a* at both end portions of the stay 24 in the longitudinal direction of the stay 24 to restrict movement of the stay 24 relative to the support 32. Each step portion 24*a* abuts the support 32 to restrict movement of the stay 24 in the longitudinal direction with respect to the support 32. However, at least one of the step portions 24*a* is arranged to have a gap, that is, loose fit with play between the step portion 24*a* and the support 32. The above-described arrangement of the gap between the support 32 and at least one of the step portions 24*a* allows an expansion and contraction of the stay 24 due to the temperature change.

Figure 8:
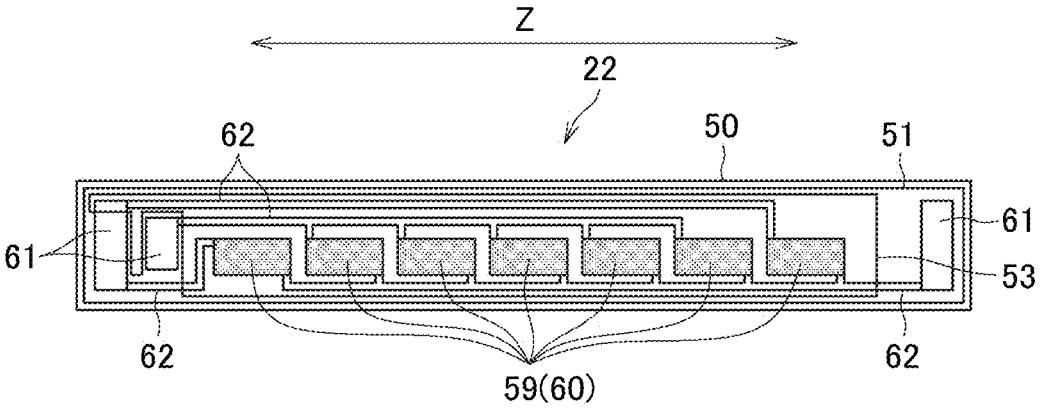
FIG. 8 is a plan view of a heater according to an embodiment of the present disclosure.
Figure 9:
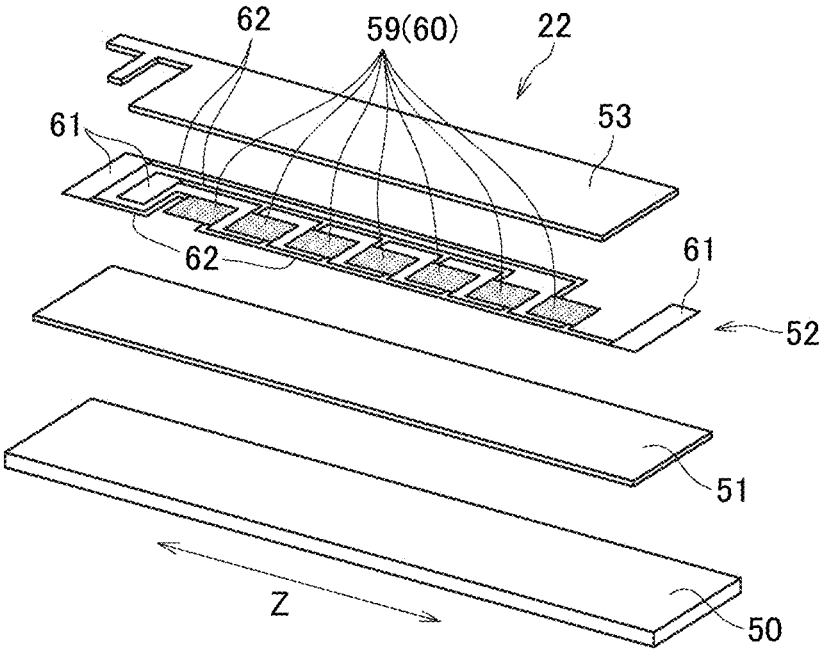
FIG. 9 is an exploded perspective view of the heater of FIG. 8.

FIG. 8 is a plan view of the heater 22 according to the present embodiment, and FIG. 9 is an exploded perspective view of the heater 22.

As illustrated in FIG. 9, the heater 22 includes a plurality of resistive heat generators 59 arranged on the first insulation layer 51 disposed on the base 50. The plurality of resistive heat generators configure the heat generator 60. The resistive heat generators 59 are arranged in a line in a longitudinal direction Z of the base 50. The conductor layer 52 includes a plurality of electrodes 61 and a plurality of power supply lines 62 as a plurality of conductors in addition to the plurality of resistive heat generators 59. Each of the resistive heat generators 59 is electrically connected to any two of the plurality of electrodes 61 via the plurality of power supply lines 62. As illustrated in FIG. 8, the heater 22 includes the second insulation layer 53 covering every resistive heat generators 59 and most of power supply lines 62 to ensure the insulation between them. Since the resistive heat generators 59 are arranged at intervals, the second insulation layer 53 functions an insulating region interposed between the adjacent resistive heat generators 59. In contrast, the second insulation layer 53 does not cover most of the electrodes 61 to expose the electrodes 61 so as to be connected to the connector described below.

For example, the heat generators 59 are produced as below. Silver-palladium (AgPd), glass powder, and the like are mixed to make paste. The paste is coated to the base 50 by screen printing or the like. Thereafter, the base 50 is subject to firing. Then, the heat generators 59 are produced. The material of the resistive heat generator 59 may contain a resistance material, such as silver alloy (e.g. AgPt) or ruthenium oxide (e.g. RuO2).

The electrodes 61 and the power supply lines 62 are made of conductors having an electrical resistance value smaller than the electrical resistance value of the resistive heat generators 59. The electrodes 61 and the power supply lines 62 may be made of a material prepared with silver (Ag), silver-palladium (AgPd), or the like. Screen-printing such a material on the first insulation layer 51 disposed on the base 50 forms the electrodes 61 and the power supply lines 62.

Figure 10:
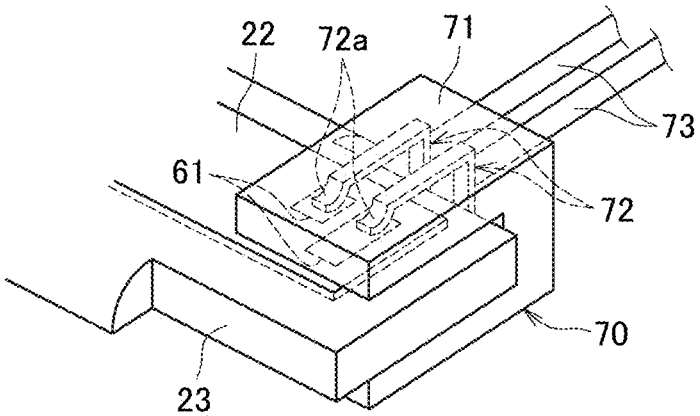
FIG. 10 is a perspective view of a connector connected to the heater according to an embodiment of the present disclosure.

FIG. 10 is a perspective view illustrating a connector 70 as a power supply member connected to the heater 22.

As illustrated in FIG. 10, the connector 70 includes a housing 71 made of resin and a plurality of contact terminals 72 fixed to the housing 71. Each contact terminal 72 is configured by a flat spring and connected to a power supply harness 73.

As illustrated in FIG. 10, the connector 70 is attached to the heater 22 and the heater holder 23 such that the connector 70 sandwiches the heater 22 and the heater holder 23 together. Thus, the connector 70 holds the heater 22 and the heater holder 23 together. In the above-described state, contact portions 72*a* disposed at ends of the contact terminals 72 in the connector 70 elastically contact and press against the electrodes 61 each corresponding to the contact terminals 72 to electrically connect electrodes 61 and contact terminals 72, respectively. Similarly, another connector 70 is connected to the electrode 61 located at an end opposite the electrode 61 illustrated in FIG. 10 in the longitudinal direction of the heater 22. The above-described configuration enables the power supply disposed in the image forming apparatus to supply power to the heat generator 60 via the connector 70.

Figure 11:
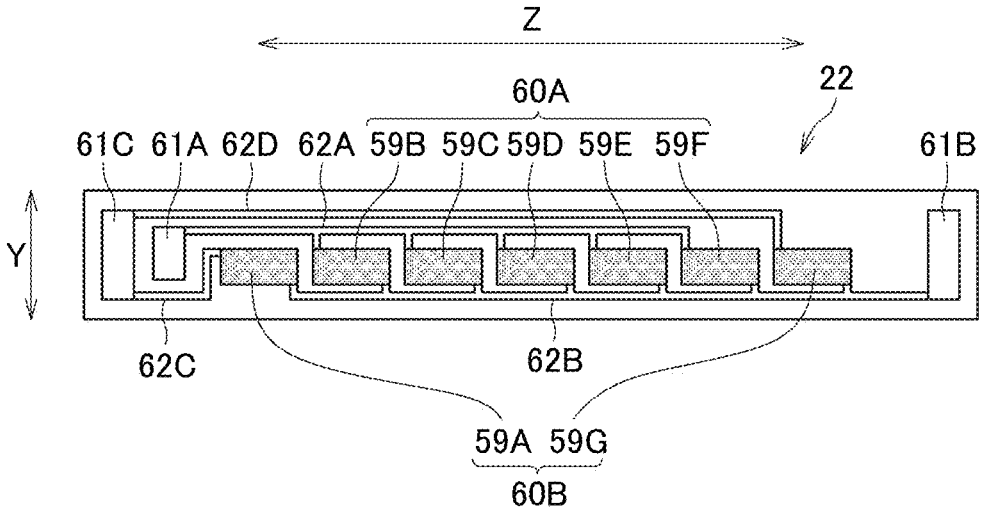
FIG. 11 is a plan view of the heater of FIG. 8.

With reference to FIG. 11, the following describes a configuration of the heater 22 according to the present embodiment in detail.

As illustrated in FIG. 11, the heater 22 according to the present embodiment includes seven resistive heat generators 59A to 59G, three electrodes 61A to 61C, and four power supply lines 62A to 62D that connect between the resistive heat generators 59A to 59G and the electrodes 61A to 61C. Two electrodes 61A and 61C of the three electrodes 61A to 61C are disposed on one end portion of the first insulation layer 51 (that is a left end portion of the heater 22 in FIG. 11) in the longitudinal direction Z of the base 50 with respect to the resistive heat generators 59A to 59G, and the remaining one electrode 61B is disposed on the other end portion of the first insulation layer 51 (that is a right end portion of the heater 22 in FIG. 11) in the longitudinal direction Z of the base 50 with respect to the resistive heat generators 59A to 59G. Each of the resistive heat generators 59A to 59G is electrically connected to any one of the two electrodes 61A and 61C disposed on the one end portion of the first insulation layer 51 and the electrode 61B disposed on the other end portion of the first insulation layer 51.

Specifically, the resistive heat generators 59B to 59F of the seven resistive heat generators 59A to 59G that are resistive heat generators other than the resistive heat generators disposed on the both ends are connected in parallel with each other to the first electrode 61A through the first power supply line 62A and the second electrode 61B through the second power supply line 62B. The resistive heat generators 59A and 59G on both ends are connected in parallel to the third electrode 61C through the third power supply line 62C and the fourth power supply line 62D, respectively, and the second electrode 61B through the second power supply line 62B.

In the present embodiment, the above-described connection structure enables independently controlling heat generation in a first heat generator 60A configured by the resistive heat generators 59B to 59F other than the resistive heat generators on both ends and heat generation in a second heat generator 60B configured by the resistive heat generators 59A and 59G on both ends separately. Specifically, applying a voltage to the first electrode 61A and the second electrode 61B generates an electric potential difference between the first electrode 61A and the second electrode 61B and energizes the resistive heat generators 59B to 59F other than the resistive heat generators 59A and 59G on both ends, and the first heat generator 60A generates heat alone. On the other hand, applying the voltage to the second electrode 61B and the third electrode 61C generates an electric potential difference between the second electrode 61B and the third electrode 61C and energizes the resistive heat generators 59A and 59G on both ends, and the second heat generator 60B generates heat alone. Specifically, applying the voltage to all the electrodes 61A to 61C generates the electric potential difference between the first electrode 61A and the second electrode 61B and the electric potential difference between the second electrode 61B and the third electrode 61C and energizes all the resistive heat generators 59A to 59G, and both the first heat generator 60A and the second heat generator 60B generate heat For example, the first heat generator 60A generates heat alone to fix the toner image on a sheet P having a relatively small width conveyed, such as the sheet P of A4 size (sheet width: 210 mm) or a smaller sheet P, and the second heat generator 60B generates heat together with the first heat generator 60A to fix a toner image on a sheet P having a relatively large width conveyed, such as a sheet P larger than A4 size (sheet width: 210 mm). As a result, the heater 22 can have a heat generation area corresponding to the sheet width.

The following describes a temperature variation (a temperature distribution deviation) occurring in the heater 22 according to the present embodiment.

Generally, the power supply line slightly generates heat when the resistive heat generator generates heat in the heater including the resistive heat generator connected to the electrodes through the power supply lines as described above. The heat generation distribution of the power supply lines may cause the temperature variation in the temperature distribution of the heater. In particular, increasing currents flowing through the resistive heat generators to increase heat generation amount and the speed of the image forming apparatus increases the amounts of heat generated in the power supply lines. As a result, affection by the heat generated in the power supply lines can not be ignored.

Figure 12:
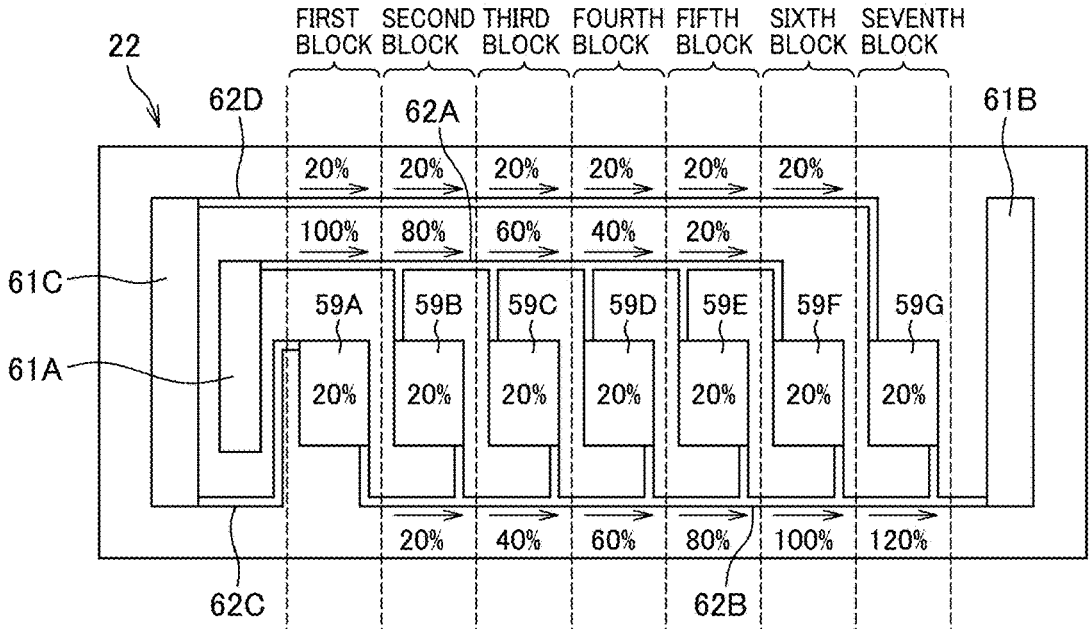
FIG. 12 is a schematic diagram illustrating heat generation amounts generated by power supply lines in each block of the heater depicted in FIG. 8 when all resistive heat generators generate heat.
Figure 12:
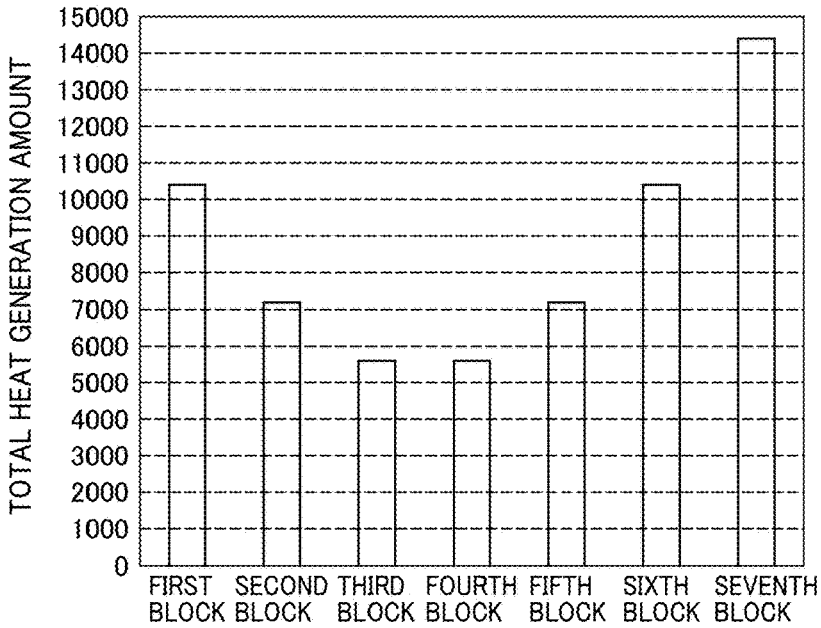

FIG. 12 illustrates blocks separated so as to include each of the resistive heat generators 59A to 59G and heat generation amounts generated by each of the power supply lines 62A, 62B, and 62C and a total heat generation amount in each block when the current with the same value flows through each of the resistive heat generators 59A to 59G. The current value is simply referred to as 20%. In addition, a direction Y in FIG. 11 is referred to as a short-side direction of the base 50. The short-side direction Y intersects the longitudinal direction Z along the face of the first insulation layer 51 on the base 50 on which the resistive heat generators 59 are disposed Since the portion of each power supply line extending in the short-side direction Y is short and generates a small heat generation amount, the heat generation amount in the short portion is eliminated. The table illustrated in FIG. 12 simply indicates the calculated heat generation amounts each generated in a portion of each of the power supply lines 62A, 62B, and 62D extending in the longitudinal direction Z. Since a heat generation amount (W) is represented by the following equation (1), each of the heat generation amounts indicated in the table of FIG. 12 is calculated as the square of a current (I) flowing through each of the power supply lines for convenience. Therefore, the numerical values of the heat generation amounts indicated in the table of FIG. 12 are merely values calculated simply and may be different from the actual heat generation amount.

$$W=R\times I^2, \qquad \text{Equation (1)}$$

In the equation (1), W represents the heat generation amount, R represents the resistance and I represents the current.

With continued reference to FIG. 12, a description is given of a specific way of calculating the heat generation amount for the first and second blocks, for example. In the first block in FIG. 12, a proportion of a current flowing through the fourth power supply line 62D to the current flowing through the first power supply line 62A is 20%, and the proportion of the current flowing through the first power supply line 62A is expressed as 100%. Therefore, the total heat generation amount generated by the first power supply line 62A and the fourth power supply line 62D in the first block is expressed as 10400, which is the total value of the square of 100 (i.e., 10000) and the square of 20 (i.e., 400). In the second block, a proportion of a current flowing through the first power supply line 62A is 80%, a proportion of a current flowing through the second power supply line 62B is 20%, and a proportion of a current flowing through the fourth power supply line 62D is 20%. Therefore, the total heat generation amount of the power supply lines 62A, 62B, and 62D in the second block is expressed as 7200 (6400+400+400), which is the sum of the squares of the above-described proportions of the currents. The heat generation amounts in other blocks are similarly calculated.

The y-axis in the graph in FIG. 12 represents the total heat generation amounts described above in the blocks. As can be seen from this graph, the total heat generation amounts generated by the power supply lines in blocks disposed both ends are larger than the total heat amount of the center block. In addition, the total heat generation amounts generated by power supply lines in the blocks symmetrical with respect to the center (for example, the first block and the seventh block) are also different. The above-described variation in the heat generation distribution generated by the power supply lines over the longitudinal direction Z of the base causes the variation in the heat generation distribution of the heater.

The temperature variation caused by the above-described variation in the heat generation distribution generated by the power supply lines may occur not only when all the resistive heat generators generate heat as described in FIG. 12 but also when a part of the resistive heat generators generate heat. In particular, when downsizing the heater or increasing a print speed of the image forming apparatus causes an unintended shunt in the power supply line, the temperature variation may become significant. The unintended shunt easily occurs when reducing a width of the power supply lines in the short-side direction of the heater to downsize the heater in the short-side direction increases the resistance values of the power supply lines or when the resistance values of the resistive heat generators are set to be small to increase the heat generation amounts of the resistive heat generators to increase the print speed of the image forming apparatus. That is, when the resistance value of the power supply line and the resistance value of the resistive heat generator are relatively close to each other in accordance with downsizing the heater or increasing the print speed, a current may flow through a path through which the current did not flow before, that is, the unintended shunt may occur.

Figure 13:
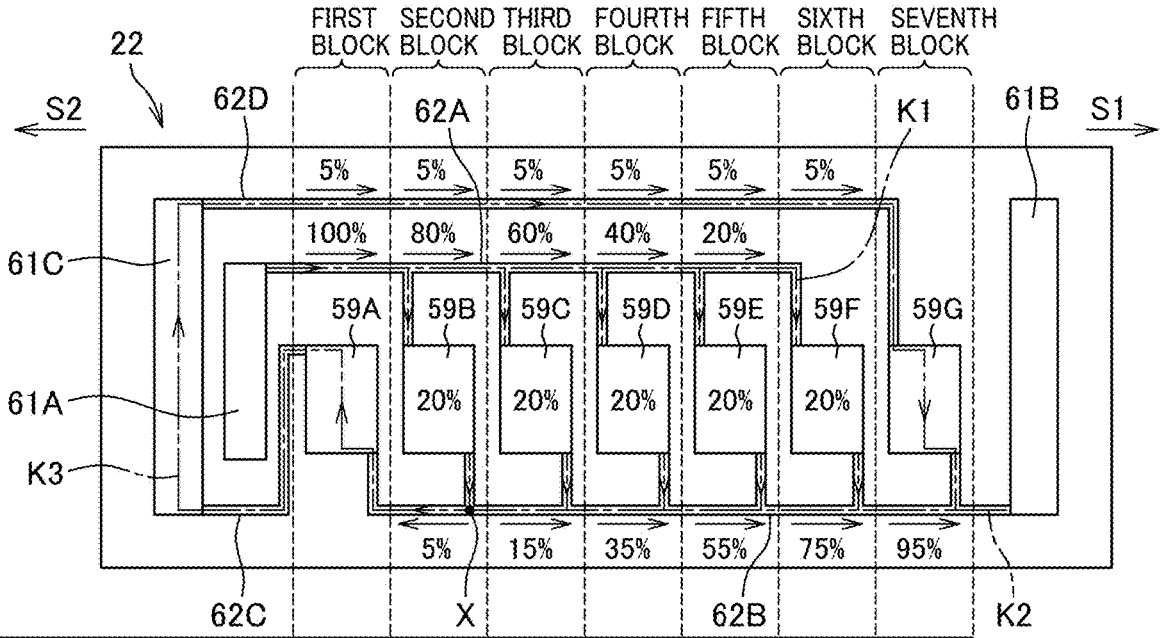
FIG. 13 is a schematic diagram illustrating heat generation amounts generated by power supply lines in each block of the heater depicted in FIG. 8 when some of the resistive heat generators generate heat.
Figure 13:
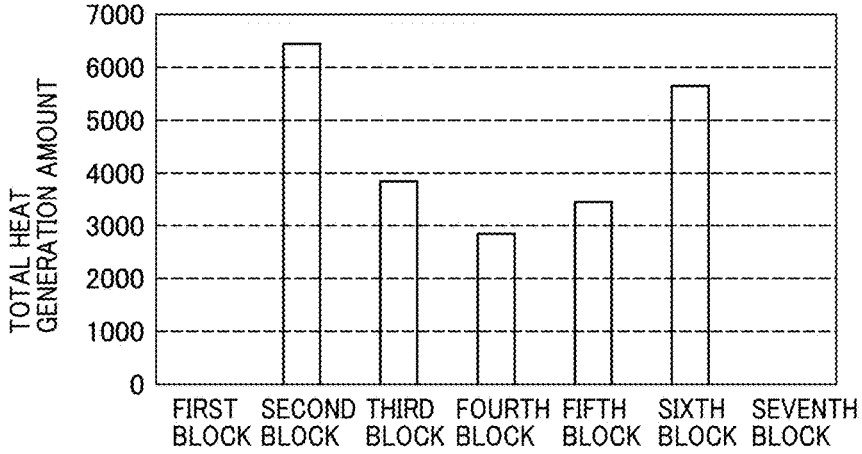

For example, energizing the first heat generator 60A configured by the resistive heat generators 59B to 59F other than the resistive heat generators on both ends as illustrated in FIG. 13 may generate the unintended shunt. That is, a part of the current passing through the second resistive heat generator 59 from the left in FIG. 13 may not flow to the second electrode 61B from a branch X of the second power supply line 62B to which the current flow from the second resistive heat generator 59, but may flow opposite side of the second electrode 61B from the branch X. The shunted current then passes through the resistive heat generator 59A arranged on the left end in FIG. 13 and further passes through the third power supply line 62C, the third electrode 61C, the fourth power supply line 62D, and the resistive heat generator 59G arranged on the right end in FIG. 13 in this order. Finally, the current joins the second power supply line 62B.

As described above, the unintended shunt passes through a branch path indicated by the alternate long and short dash line K3 in FIG. 13 from the branch X to reach the second power supply line 62B. The above-described unintended shunt may occur in the configuration like the heater 22 according to the present embodiment that includes a conductive path including at least a first conductive path (a first conductor) K1, a second conductive path (a second conductor) K2, and a third conductive path (the shunted current path) K3. The first conductor K1 connects the first electrode 61A and the first heat generator 60A configured by the resistive heat generators 59B to 59F other than the resistive heat generators on both ends. The second conductor K extends from the first heat generator 60A in a first direction S1 that is a longitudinal direction toward the right side in FIG. 13) in the heater 22 to connect the first heat generator 60A and the second electrode 61B. The third conductive path K3 is included in the shunted current path that flows current from the second conductive path K2 to the second electrode 61B without passing through the first conductive path K1. In the present embodiment, the third conductive path K3 included in the shunted current path includes the third electrode 61C and the second heat generator 60B configured by the resistive heat generators 59A and 59G on both ends in addition to a third conductor. The third conductor includes the fourth power supply line 62D, the third power supply line 62C, and a part of the second power supply line 62B that is a left part from the branch X in FIG. 13. The third conductive path K3 included in the shunted current path may be configured by only a power supply line and not include the resistive heat generator and the electrode. The unintended shunt may flow such a conductive path.

A table and a graph in FIG. 13 illustrate heat generation amounts generated by each of the first power supply line 62A, the second power supply line 62B, and the fourth power supply line 62D and their total heat generation amounts in each of the blocks of the heater 22 flowing the unintended shunt. In the example of FIG. 13, the heat generation amounts generated by each of the first power supply line 62A, the second power supply line 62B, and the fourth power supply line 62D in each of the blocks (from the second block to the sixth block) energized to generate heat are calculated when the current with the same value 20% flows through each of the resistive heat generators 59B to 59F other than the resistive heat generators on both ends, and a part of these currents 5% separates from the branch X and flows through the third conductive path. The method of calculating the heat generation amount is the same as the method described in the example in FIG. 12. In the examples in FIGS. 12 and 13, the current flows in one direction, but the present disclosure is not limited to this. The current flowing through the heater 22 may be alternating current.

As can be seen from the table and the graph in FIG. 13, the total heat generation amounts generated by the power supply lines in both end blocks of the first heat generator are also larger than the total heat amount of the center block in this case, and the variation in the heat generation distribution occurs. However, contrary to the graph in FIG. 12, the total heat generation amount in the left end block is larger than the total heat generation amount in the right end block in the graph in FIG. 13. As a result, a temperature in the left end block is higher than a temperature in the right end block.

As described above, the variation in the heat generation amounts generated by the power supply lines in each block causes the variation in the temperature distribution of the heater over the longitudinal direction in the fixing device according to the present embodiment. The above-described variation in the temperature distribution of the heater affects not only the fixing device hut also other devices in the image forming apparatus. That is, the temperature distribution in the heater affects the above-described protectant supply device 7 to supply the image bearer the lubricant and may cause a variation in lubricant supply amounts.

In general, the lubricant supply amount changes according to a frictional force of the lubricant supplier such as the brush roller 81 illustrated in FIG. 2 with respect to the lubricant. Accordingly, the rotation speed or the material of the lubricant supplier is a parameter to design and specify the lubricant supply amount. However, since the hardness of the lubricant supplier changes according to the temperature of the lubricant supplier, change in the temperature of the lubricant supplier causes variation in the lubricant supply amount. That is, as the temperature of the lubricant supplier is higher, the lubricant supplier becomes softer, and thus the lubricant supply amount tends to decrease.

Figure 14:
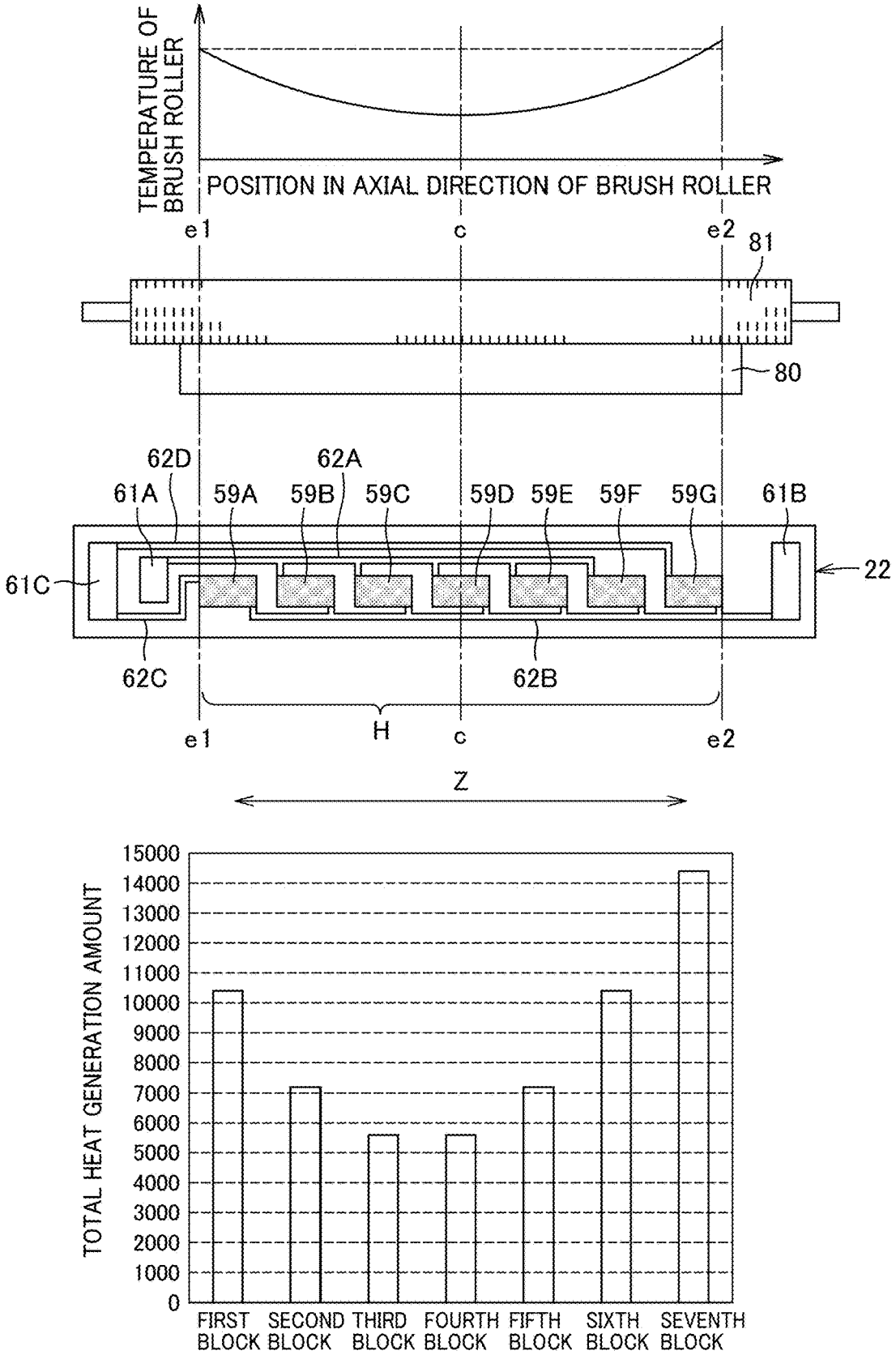
FIG. 14 is a diagram illustrating a relationship between a temperature distribution of the heater and a temperature distribution of a brush roller.

The above-described variation in the temperature distribution of the heater affects the lubricant supplier and generates a high-temperature portion and a low-temperature portion in the lubricant supplier, and the lubricant supply amount varies accordingly. For example, as illustrated in FIG. 14, when the heater 22 includes a heat generation area H configured by arranging the plurality of resistive heat generators 59A to 59G and having one end e1 in the first block and the other end e2 in the seventh block in the longitudinal direction Z, and when a temperature at the other end e2 is higher than a temperature at the one end e1, a temperature at a portion of the brush roller 81 near the other end e2 is higher than a temperature at a portion of the brush roller 81 near the one end e1. The higher temperature in the portion of the brush roller 81 near the other end e2 decreases the lubricant supply amount. If the higher temperature in the portion of the brush roller 81 near the other end e2 decreases the lubricant supply amount to an amount less than the necessary amount, a phenomenon called filming, which causes abnormal images, occurs, and the cleaning performance for the photoconductor deteriorates.

As described above, temperature in the image forming apparatus (in particular, the temperature of the brush roller 81) correlates with the lubricant supply amount (in other words, a lubricant consumption amount). The lubricant supply amount tends to decrease in a high temperature portion of the brush roller 81. However, in addition to the temperature in the image forming apparatus and the frictional force of the brush roller 81, which are described above, a biasing force of the spring 82 (see FIG. 2) that pushes the lubricant 80 against the brush roller 81 is also a factor that affects the lubricant supply amount. That is, as the biasing force of the spring 82 increases, the lubricant 80 is more strongly pushed against the brush roller 81. The brush roller 81 more easily scrape the lubricant 80 off, and the lubricant consumption amount (the lubricant supply amount supplied from the lubricant 80) increases. Thus, since the lubricant supply amount correlates with the temperature in the image forming apparatus and the biasing force of the spring, the lubricant supply amount can be adjusted by setting the biasing force of the spring based on the temperature in the image forming apparatus.

To reduce the above-described variation in the lubricant supply amount, the biasing force of the spring that pushes the lubricant is set as follows in the image forming apparatus according to the present embodiment.

Figure 15:
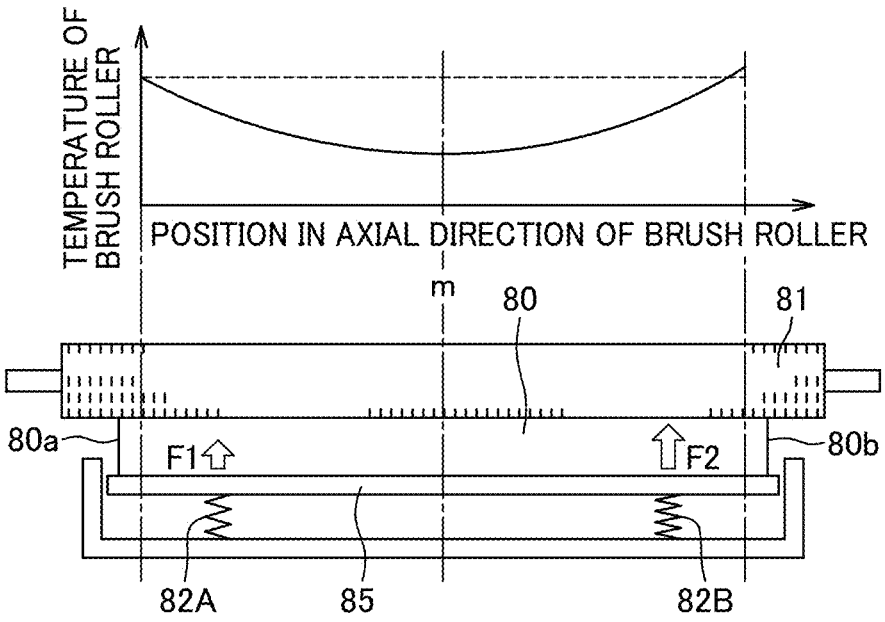
FIG. 15 is a diagram illustrating a configuration of a protectant supply device according to an embodiment of the present disclosure.

FIG. 15 is a view to describe a configuration of the protectant supply device 7 according to the present embodiment.

As illustrated in FIG. 15, the protectant supply device 7 according to the present embodiment includes a pair of springs 82A and 82B as the lubricant biasing member biasing the lubricant 80 toward the brush roller 81. The spring 82A is disposed at a position as a first position near one end 80*a* of the lubricant 80, and the spring 82B is disposed at a position as a second position near the other end 80*b* of the lubricant 80. The first position and the second position are symmetrical with respect to the longitudinal center m of the lubricant 80.

In the protectant supply device 7 according to the present embodiment, the biasing force of the spring 82A near the one end 80*a* of the lubricant 80 is set to be different from the biasing force of the spring 82B near the other end 80*b* of the lubricant 80 based on the temperature distribution of the brush roller 81 to reduce the variation in the lubricant supply amount. That is, as illustrated in FIG. 15, the biasing force F2 of the spring 82B near the other end 80*b* that biases a portion of the brush roller 81 with a relatively high temperature is set to be larger than the biasing force F1 of the spring 82A near the one end 80*a* that biases a portion of the brush roller 81 with a relatively low temperature (F1<F2). A method for setting the biasing forces of the springs 82A and 82B to be different each other may be, for example, a method using springs having different repulsive forces or a method setting different amounts of compression of the springs.

As described above, in the protectant supply device 7 according to the present embodiment, the biasing force F2 of the spring 82B facing the high temperature portion of the brush roller 81 that is generated by the variation in the temperature distribution of the heater 22 is set to be larger than the biasing force F1 of the spring 82A facing the low temperature portion of the brush roller 81. The high temperature portion of the brush roller 81 tends to decrease the lubricant supply amount, but pushing the lubricant 80 against the high temperature portion of the brush roller 81 with the larger biasing force F2 as described above can increase the lubricant supply amount. As a result, the above-described configuration can reduce the difference in the lubricant supply amount between the one end 80*a* and the other end 80*b* of the lubricant 80 in the longitudinal direction of the lubricant 80 to improve the cleaning performance for the photoconductor.

In the present embodiment, a high temperature portion of the heater 22 when all resistive heat generators 59A to 59G generate heat as illustrated in FIG. 12 is opposite to a high temperature portion of the heater 22 when the resistive heat generators 59B to 59F other than the resistive heat generators on both ends generate heat as illustrated in FIG. 13 with reference to the center (in the fourth block) in the longitudinal direction of the heat generation area. As a result, the high temperature portions of the brush roller 81 in the above cases are also opposite to each other, and distributions in the lubricant supply amount in the longitudinal direction are also opposite to each other. However, in the heater 22 according to the present embodiment, since the variation in the temperature distribution illustrated in FIG. 12 is much larger than the variation in the temperature distribution illustrated in FIG. 13, the pressing forces F1 and F2 of the springs illustrated in FIG. 15 are set corresponding to the heat generation distribution illustrated in FIG. 12. The above-described configuration can efficiently reduce the difference in the lubricant supply amount when the variation in the temperature distribution becomes significantly large, and improve the cleaning performance for the photoconductor.

In order to confirm which end portion of the brush roller 81 has a higher temperature, the temperature of the brush roller 81 may be actually measured, or the temperature of the heater 22 may be measured. For example, in the heater 22 illustrated in FIG. 14, measuring temperatures at one position as the first position and the other position as the second position on the heat generation area H that are symmetrical to each other with respect to a center line c of the heat generation area H in the longitudinal direction of the heat generation area H gives a result that the temperature at the other position (that is a right side position in FIG. 14) is higher than the temperature at the one position (that is a left side position in FIG. 14). Based on the above results, the biasing force of the spring 82 biasing the lubricant 80 at a position closer to the other position than to the one position is set to be larger than the biasing force of the spring 82 biasing the lubricant 80 at a position closer to the one position than to the other position. As long as the positions to measure the temperatures on the heater 22 are positions symmetrical to each other with respect to the longitudinal center c of the heat generation area H, arbitrary positions can be selected, such as both ends e1 and e2 in the longitudinal direction of the heat generation area H, or a pair of one intermediate position between the end e1 and the longitudinal center c and another intermediate position between the end e2 and the longitudinal center c. As illustrated in the above-described equation (1), the heat generation amount in a part of the heat generation area of the heater 22 is represented by a sum of the square of the currents flowing through the part of the heat generation area. Accordingly, the high temperature portion of the brush roller 81 may be determined by measuring currents flowing through one part and the other part on the heat generation area H that are symmetrical to each other with respect to the center line c of the heat generation area H in the longitudinal direction of the heat generation area H of the heater 22, calculating a sum of the squares of the currents flowing through the one part and a sum of the squares of the currents flowing through the other part, and comparing the sums. That is, when the sum of the squares of the currents flowing through the one part is larger than the sum of the squares of the currents flowing through the other part that is symmetric with the one part with respect to the center line c, the biasing force of the spring 82 biasing the lubricant 80 at a part corresponding to the one part may be set to be larger than the biasing force of the spring 82 biasing the lubricant 80 at a part corresponding to the other part. Similar to measurements of the temperatures, arbitrary parts may be selected as long as the parts to measure the currents on the heater 22 are parts symmetrical to each other with respect to the longitudinal center c of the heat generation area H.

Figure 16:
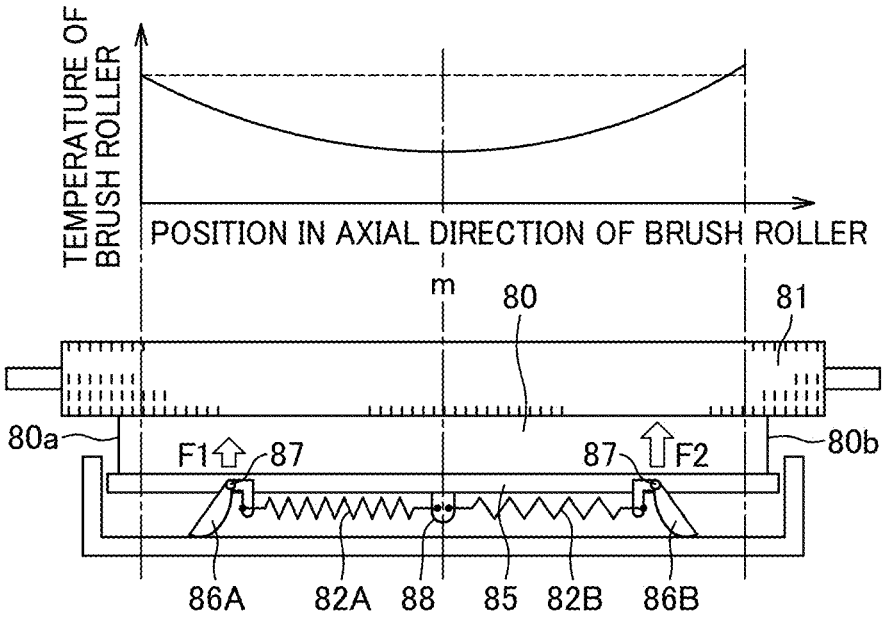
FIG. 16 is a diagram illustrating a configuration of a protectant supply device according to another embodiment of the present disclosure.

Next, another embodiment is described. FIG. 16 is a view to describe the configuration of the protectant supply device 7 according to the embodiment of the present disclosure.

As illustrated in FIG. 16, the protectant supply device 7 includes a pair of pushing members 86A and 86B pushing the lubricant 80 against the brush roller 81. The pushing member 86A is disposed at a position near the one end 80*a* of the lubricant 80, and the pushing member 86B is disposed at a position near the other end of the lubricant 80. The pair of pushing members 86A and 86B are disposed with respect to the longitudinal center m of the lubricant 80. Each of the pushing members 86A and 86B is rotatable about a support shaft 87 disposed on the lubricant holder 85. The spring 82A to bias the lubricant 80 is stretched between a fixed portion 88 disposed on the lubricant holder 85 and the pushing member 86A, and the spring 82B to bias the lubricant 80 is stretched between the fixed portion 88 and the pushing member 86B. Tensile forces act on the pushing members 86A and 86B. Accordingly, the pushing members 86A and 86B push the lubricant holder 85 upward in FIG. 16 to push the lubricant 80 against the brush roller 81.

In the present embodiment, tensions of the springs 82A and 82B are set to be different from each other to improve the above-described variation in the lubricant supply amount. That is, the tensions of the springs 82A and 82B are set to be different from each other so that the biasing force F2 of the spring 82B disposed corresponding to the high temperature portion of the brush roller 81 is larger than the biasing force F1 of the spring 82A disposed corresponding to the low temperature portion of the brush roller 81. Similar to the embodiment firstly described, the above-described configuration can reduce the variation in the lubricant supply amount and improve the cleaning performance for the photoconductor. In order to confirm which end portion of the brush roller 81 has a higher temperature in the present embodiment, the temperature of the brush roller 81 may be also actually measured. Alternatively, the high temperature portion of the brush roller 81 may be determined based on the temperature of the heater 22 (the heat generation amounts in parts of the heater 22) or the sums of the squares of currents flowing through parts in the heater 22.

Figure 17:
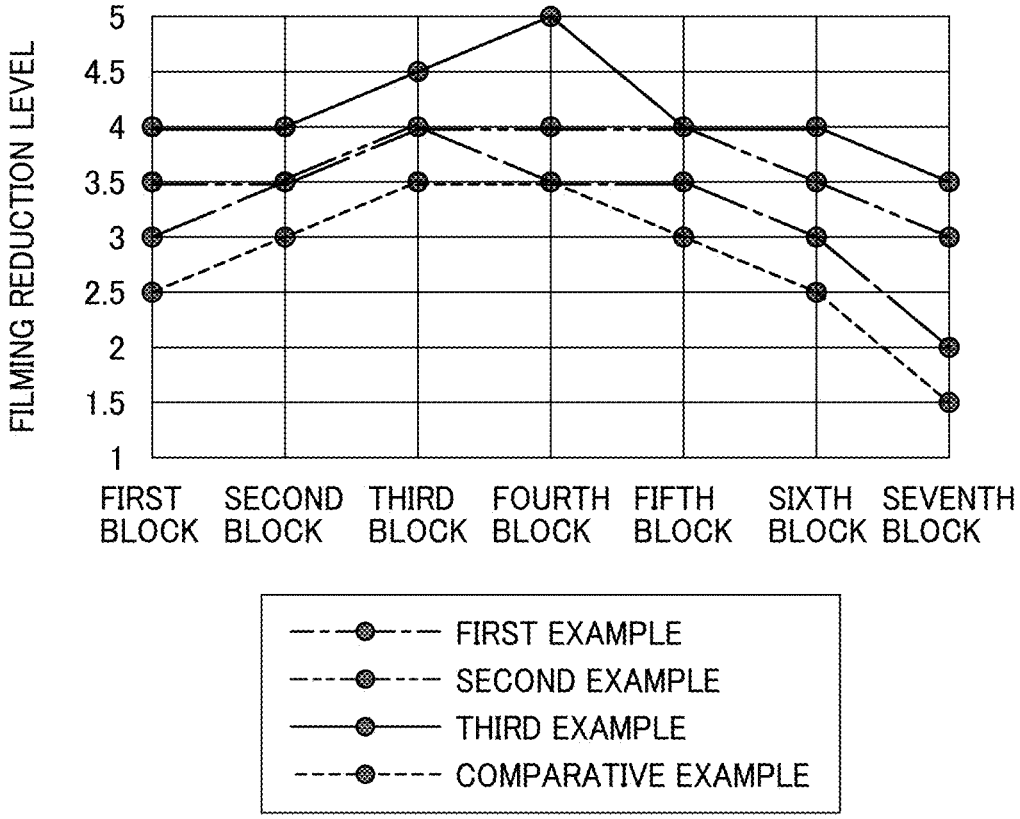
FIG. 17 is a graph illustrating results of tests for examining effects of reducing filming.

FIG. 17 is a graph illustrating results of tests for examining effects of reducing filming.

In this test, the protectant supply devices according to first to third examples of the present disclosure and the protectant supply device according to a comparative example were made, and filming reduction levels on the photoconductors were examined in every examples. In the graph illustrated in FIG. 17, the vertical axis indicates the filming reduction level, and the higher the numerical value of the filming reduction level is, the higher filming reduction effect is. The horizontal axis of FIG. 17 indicates positions corresponding to the first to seventh blocks separated so as to include each of the resistive heat generators of the heater as described above. In FIG. 17, an alternate long and short dash line indicates the test results of the first example, an alternate long and two short dashes line indicates the test results of the second example, a solid line indicates the test results of the third example, and a dushed line indicates the test results of the comparative example.

In the protectant supply devices according to first to third examples of the present disclosure, the biasing force of the spring as the lubricant biasing member biasing the lubricant to the high temperature portion of the brush roller was set to be relatively larger than the biasing force of another spring. In addition, a lateral difference in the biasing force in the second example was set to be larger than a lateral difference in the biasing force in the first example, and a lateral difference in the biasing force in the third example was set to be larger than the lateral difference in the biasing force in the second example. On the other hand, in the comparative example, the biasing force of the spring biasing the one end portion of the lubricant was set to be the same as the biasing force of the spring biasing the other end portion of the lubricant. That is, a lateral difference in the biasing forces in the comparative example was set to be zero.

As illustrated in FIG. 17, according to the results of this test, the filming reduction effect in the first to third examples according to the present disclosure was higher than the filming reduction effect in the comparative example. Additionally, in comparison among the results of the first to third examples of the present disclosure, as the lateral difference in the biasing force was larger, a higher filming reduction effect was obtained. That is, it was confirmed that setting the biasing force of the spring as the lubricant biasing member biasing the high temperature portion of the brush roller to be larger can effectively reduce the variation in the lubricant supply amount and improve the cleaning performance for the photoconductor.

As described above, the image forming apparatus according to the present disclosure can reduce the variation in amounts of the protectant applied to the image bearer and prevent the occurrence of the abnormal image caused by uneven supply or insufficient supply of the protectant to the image bearer even when the image forming apparatus has the temperature difference in the heater.

Use of zinc stearate as fatty acid metallic salt added to the lubricant or use of boron nitride as inorganic lubricant added to the lubricant can stably maintain the lubricant supply amounts for the photoconductor over time and therefore, prevent the occurrence of the filming and deterioration of the photoconductor caused by the abrasion of the photoconductor. The use of the lubricants described above extends the life of the lubricant.

Figure 18:
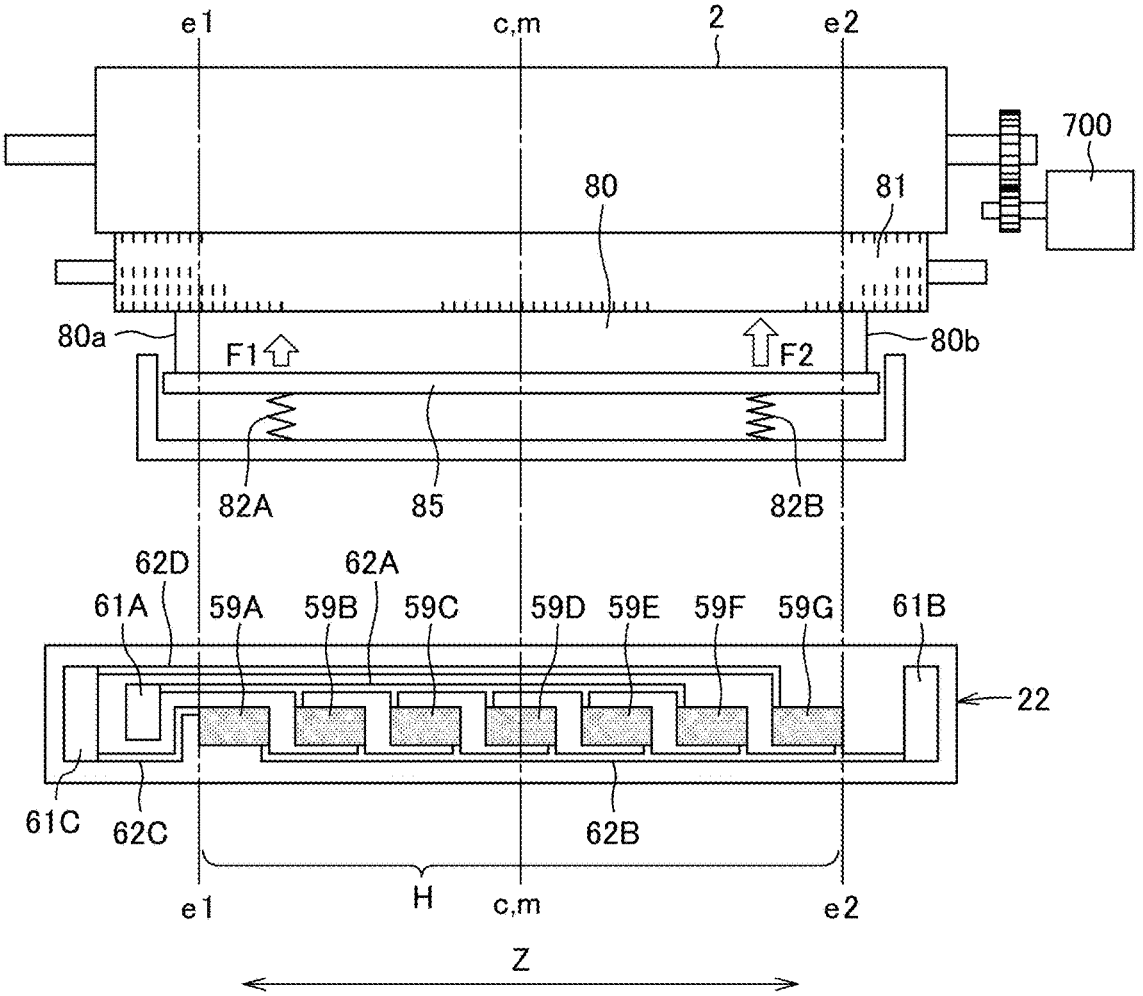
FIG. 18 is a diagram illustrating an example in which a driver is disposed near one end of the fixing device.
Figure 18:
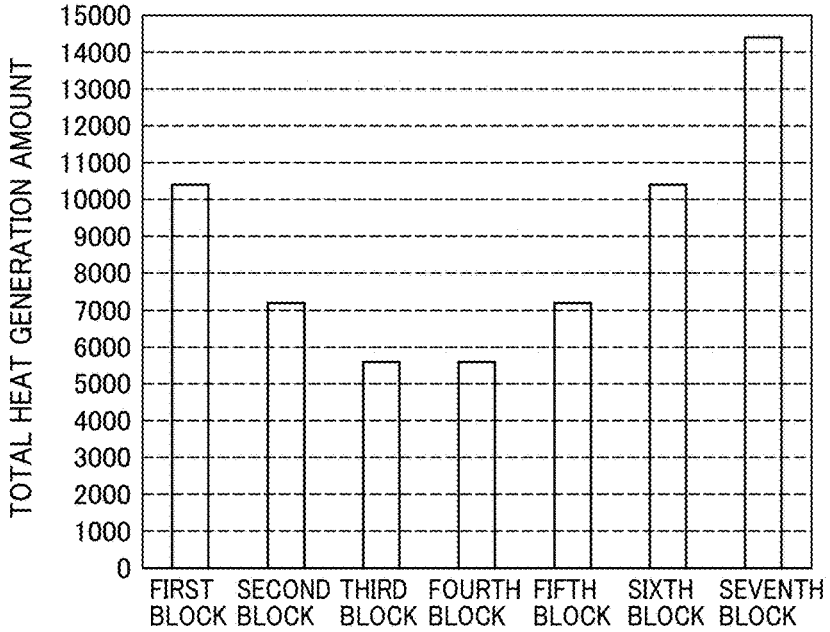

The embodiment of the present disclosure is also suitable for a configuration as illustrated in FIG. 18 in which a driver 700 to drive and rotate the photoconductor 2 is disposed on one side (right side in FIG. 18) with respect to the longitudinal center c of the heat generation area H of the healer 22 as illustrated in FIG. 18. In this configuration, the driver 700 is disposed near the seventh block in which the heater 22 generates larger heat than other portions of the heater 22. Therefore, in addition to the heat generated by the heater 22, heat generated by driving the driver 700 further increases the temperature on one side (the right side in FIG. 18) of the brush roller 81 in the axial direction of the brush roller 81. Accordingly, the biasing force F2 of the spring 82B disposed near the driver 700 is preferably set larger than the biasing force of another spring in the above-described configuration including the driver 700 disposed on the one side. The above-described configuration can efficiently reduce the variation in the lubricant supply amount.

Since the embodiments of the present disclosure can improve situations caused by the variation in the amounts of the protectant supplied to the image bearer due to the variation in temperature distribution of the heater, the embodiments can be applied to a configuration using a small heater that is likely occur the variation in the temperature distribution or a configuration using a heater that has a large heat generation ability for high speed printing. By the way, the following three methods are considered as examples of methods to downsize the heater in the short-side direction of the heater.

A first method is downsizing the heat generator (i.e., resistive heat generators) in the short-side direction of the heater. However, downsizing the heat generator in the short-side direction of the heater narrows a heating span over which the fixing belt is heated, resulting in an increase in the temperature peak of the heater to maintain the same amount of heat applied to the fixing belt as the amount of heat applied before the heating span is narrowed. The increase in the temperature peak of the heater may cause the temperature of an overheating detector such as a thermostat or a fuse disposed on a hack surface of the heater to exceed a heat resistant temperature. Alternatively, the increase in the temperature peak of the heater may cause malfunction of the overheating detector. In addition, the increase in the temperature peak of the heater also reduces the efficiency of heat conduction from the heater to the fixing belt. Therefore, the increase in the temperature peak of the heater is unfavorable from the viewpoint of energy efficiency. As described above, downsizing the heat generator in the short-side direction of the heater is hardly adopted.

A second method is downsizing, in the short-side direction of the heater, parts of the heater that are not any one of the heat generator, the electrode, and the power supply line. However, this method shortens a distance between the heat generator and the power supply line or between the electrode and the power supply line, thus failing to secure the insulation. Considering the structure of the current heater, it is difficult to further shorten the distance between the heat generator and the power supply line or between the electrode and the power supply line.

The remaining third method is to reduce the size of the power supply line in the short-side direction of the heater. This method has room for implementation as compared with the above two methods. However, reducing the size of the power supply line in the short-side direction increases the resistance value of the power supply line. Therefore, an unintended shunt may occur on a conductive path of the heater and increase the variation in the temperature distribution. In particular, if a resistance value of the heat generator is reduced to increase the amount of heat generated by the heart generator to speed up the image forming apparatus, the resistance value of the power supply line and the resistance value of the heat generator get relatively close to each other. In such a situation, an unintended shunt tends to occur. In order to prevent such an unintended shunt, the power supply lines may be upsized in a thickness direction of the heater (i.e., direction intersecting the longitudinal and short-side directions of the heater) while being downsized in the short-side direction of the heater. Such a configuration secures the cross-sectional area of the power supply lines and prevents an increase in resistance value of the power supply lines. However, in such a case, the screen printing of the power supply lines is difficult, resulting in a change of the way of forming the power supply lines. Therefore, thickening the power supply lines is hardly adopted as a solution. In conclusion, in order to downsize the heater in the short-side direction of the heater, the power supply lines are downsized in the short-side direction of the heater in anticipation of an increase in resistance value, while a measure is taken against the unintended shunt and the variation in the heat generation distribution of the heater that may be caused by downsized power supply lines. In the present embodiment of the present disclosure, setting the biasing force of the spring biasing the one portion of the lubricant to be larger than the biasing force of the spring biasing the other portion of the lubricant that is symmetric with the one portion with respect to the center of the lubricant as described above can reduce the variation in the lubricant supply amounts that is caused by the variation in the temperature distribution.

Specifically, a particularly large effect can be expected by applying the present embodiment of the present disclosure to the image forming apparatus including the following small heater.

Figure 19:
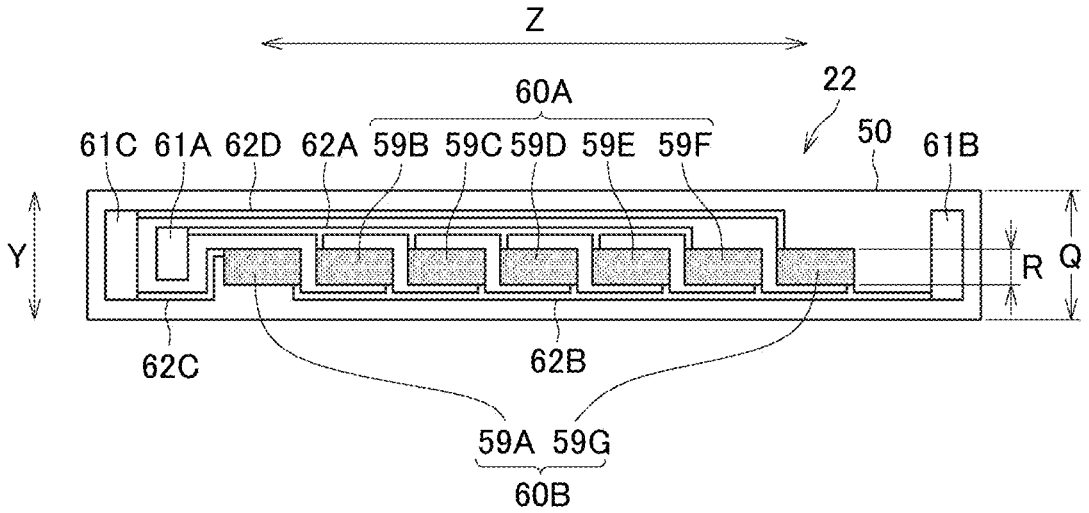
FIG. 19 is a plan view of a downsized heater according to an embodiment of th present disclosure.

The following Table 1 describes temperature differences caused by the variations in the heat generation distributions of the heaters that are downsized in the short-side direction. In each of experiments to obtain the results illustrated in Table 1, the temperature difference between the center and the end in the longitudinal direction of the heat generation area of each heater was measured. The heaters have different ratios (R/Q) of short-side dimensions R and Q. The short-side dimension R is a dimension of the resistive heat generators 59A to 59G in the short-side direction of the resistive heat generators 59A to 59G, and the short-side dimension Q is a dimension of the base 50 in the short-side direction of the base 50, as illustrated in FIG. 19. The surface temperatures of the heater were measured using an infrared thermography FLIR T620 manufactured by FUR Systems. When the ratio (R Q) of the short-side dimensions R and Q is 80% or more, the ratio of the short-side dimension of the resistive heat generators 59A to 59G to the short-side dimension of the base 50 is too large to design spaces for disposing the power supply lines. Therefore, designing the heater having the ratio (R/Q) 80% or more is difficult. Thus, the measurement about the heater having the ratio (R/Q) 80% or more is suspended.

TABLE 1

| RATIO (R/Q) OF DIMENSIONS IN SHORT-SIDE DIRECTION | TEMPERATURE DIFFERENCE BETWEEN END AND CENTER |
|---|---|
| NOT LESS THAN 20% AND LESS THAN 25% | LESS THAN 2° C. |
| NOT LESS THAN 25% AND LESS THAN 40% | 2° C. OR MORE AND LESS THAN 5° C. |
| NOT LESS THAN 40% AND LESS THAN 70% | 5° C. OR MORE |
| NOT LESS THAN 70% AND LESS THAN 80% | 5° C. OR MORE |
| NOT LESS THAN 80% | — |

As illustrated in Table 1, the larger the ratio (R/Q) of the dimensions in the short-side direction is, the larger the temperature difference between the longitudinal center of the heat generation area and the end portion of the heat generation area is. This means that the temperature difference between both end portions of the heater in the longitudinal direction of the healer is likely to be significantly large in the heater having the large ratio (R/Q) of the dimensions in the short-side direction, that is, in the heater miniaturized in the short-side direction. In particular, the heater having the ratio (R/Q) of the dimensions in the short-side direction that is 25% or more or 40% or more has a large temperature difference between the center and the end portion in the longitudinal direction of the heat generation area, that is, 5° C. or more, and thus the temperature difference between the both end portions of the heater in the longitudinal direction is likely to become significantly large. Accordingly, particularly large effect can be expected by applying the present embodiment of the present disclosure to the image forming apparatus including the heater having the ratio (R/Q) of the dimensions in the short-side direction that is equal to or larger than 25% and smaller than 80% or equal to or larger than 40% and smaller than 80%.

Figure 20:
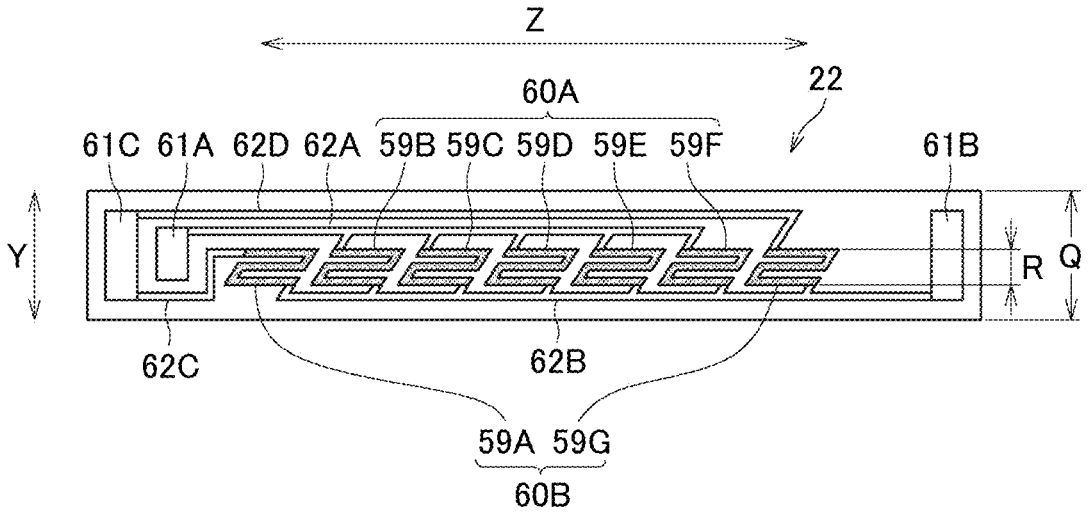
FIG. 20 is a plan view of a heater according to another embodiment of the present disclosure.

The heater disposed in the fixing device is not limited to the heater 22 including block-shaped (in other words, square-shaped) resistive heat generators 59A to 59G as illustrated in FIG. 19. The heaters 22 may include resistive heat generators 59A to 59G each having a shape in which a straight line is fielded back as illustrated in FIG. 20. Note that, in the heater 22 illustrated in FIG. 20, the short-side dimension R of each of the resistive heat generators 59A to 59G refers to a short-side dimension of each of the entire resistive heat generators 59A to 59G, not to a thickness of the straight-line portion of the resistive heat generator 59A to 59G folded back. In the embodiments illustrated in FIGS. 19 and 20, the base 50 of the heater 22 is a rectangle and therefore the short-side dimension Q of the base 50 remains unchanged at any position of the heater 22 in the longitudinal direction Z. By contrast, the short-side dimension Q of the base 50 may be changed depending on the longitudinal position of the heater 22. In such a case, the short-side dimension Q of the base 50 is a smallest dimension of the base 50 in the short-side direction within a longitudinal area (the heat generation area) including the resistive heat generators 59A to 59G arranged in the longitudinal direction of the base 50.

Figure 21:
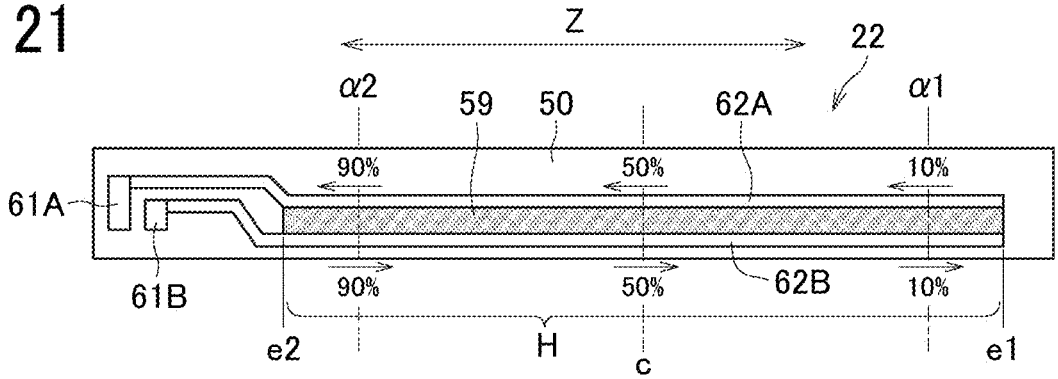
FIG. 21 is a plan view of a heater according to still another embodiment of th present disclosure.

The heater disposed in the fixing device may include one resistive heat generator 59 extending in the longitudinal direction Z of the base 50 as illustrated in FIG. 21. In this example, the first electrode 61A is coupled to one of the two sides that are the upper and lower sides of the resistive heat generator 59 (in FIG. 21, the upper side) via the first power supply line 62A, and the second electrode 61B is connected to the other side (in FIG. 21, the lower side) via the second power supply line 62B. The first electrode 61A and the second electrode 61B are arranged on one end portion (the same end portion) of the base 50 away from the center of the base 50 in the longitudinal direction of the base 50. The power supply lines 62A and 62B are arranged along the longitudinal direction Z of the base 50 without being folded back in their opposite directions.

The variation in temperature distribution occurs in the above-described heater 22 when an electric potential difference occurs between the first electrode 61A and the second electrode 61B, and the resistive heat generator 59 generates heat. For example, as illustrated in FIG. 21, heat generation amounts generated in the first power supply line 62A and the second power supply line 62B are values illustrated in the table in FIG. 21 when currents flowing through the first and second power supply lines 62A and 62B at the center c in the longitudinal direction of the heat generation area H are expressed as 50%, currents flowing through the first and second power supply lines 62A and 62B at a position al as the first position are expressed as 10%, and currents flowing through the first and second power supply lines 62A and 62B at a position $\alpha 2$ as the second position are expressed as 90%. The positions $\alpha 1$ and $\alpha 2$ are symmetric with reference to the center c and near the both ends e1 and e2 of the heat generation area H, respectively. In this case, each of the heat generation amounts indicated in the table of FIG. 21 is also calculated as the square of the current (I2) flowing through each of the power supply lines for convenience.

As illustrated in the table in FIG. 21, the total heat generation amount at the position $\alpha 2$ near the other end e2 in the longitudinal direction (the left end of the heat generation area H in FIG. 21) that is a sum of the heat generation amount generated in the first power supply line 62A and the heat generation amount generated in the second power supply line 62B is larger than the total heat generation amount at the position $\alpha 1$ near the one end e1 in the longitudinal direction (the right end of the heat generation area H in FIG. 21). The above-described situations may be caused by the variation in the amounts of the protectant supplied to the image bearer due to the variation in temperature distribution of the heater. Accordingly, applying the configuration according to the embodiment to the fixing device including the above-described heater can prevent the variation in the lubricant supply amounts.

In order to decrease the variation in the temperature of the heater, the resistive heat generator having a positive temperature coefficient (PTC) characteristic may be used. PIC defines a property in which the resistance value increases as the temperature increases. Therefore, for example, a heater output decreases under a given voltage when the temperature increases. The heat generator having the PTC property starts quickly with an increased output at low temperatures and prevents overheating with a decreased output at high temperatures. For example, if a temperature coefficient of resistance (TCR) of the PTC is in a range of from about 300 ppm/° C. to about 4,000 ppm/° C., the heater 22 is manufactured at reduced costs while retaining a resistance required for the heater 22. The TCR is preferably in a range of from about 500 ppm/° C. to about 2,000 ppm/° C. The TCR can be calculated using the following equation (2). In the equation (2), T0 represents a reference temperature. T1 represents a freely selected temperature. R0 represents a resistance value at the reference temperature T0, and R1 represents a resistance value at the selected temperature T1. Fax example, in the heater 22 described above with reference to FIG. 11, the TCR is 2,000 ppm/° C. from the equation (2) when the resistance values between the first electrode 61A and the second electrode 61B are 10Ω (i.e., resistance value R0) and 12Ω (i.e., resistance value R1) at 25° C. (i.e., reference temperature T0) and 125° C. (i.e., selected temperature T1), respectively.

$$TCR=(R1-R0)/R0/(T1-T0)\times 10^6 \quad \text{Equation (2)}$$

Figure 22:
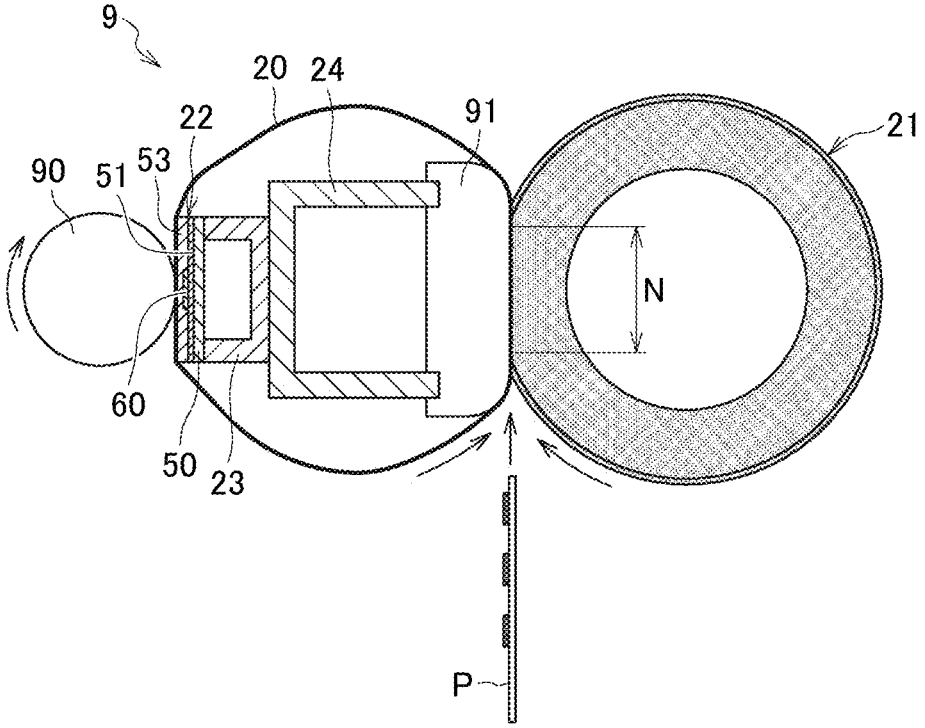
FIG. 22 is a schematic cross-sectional view of a configuration of a fixing device according to another embodiment of the present disclosure.
Figure 23:
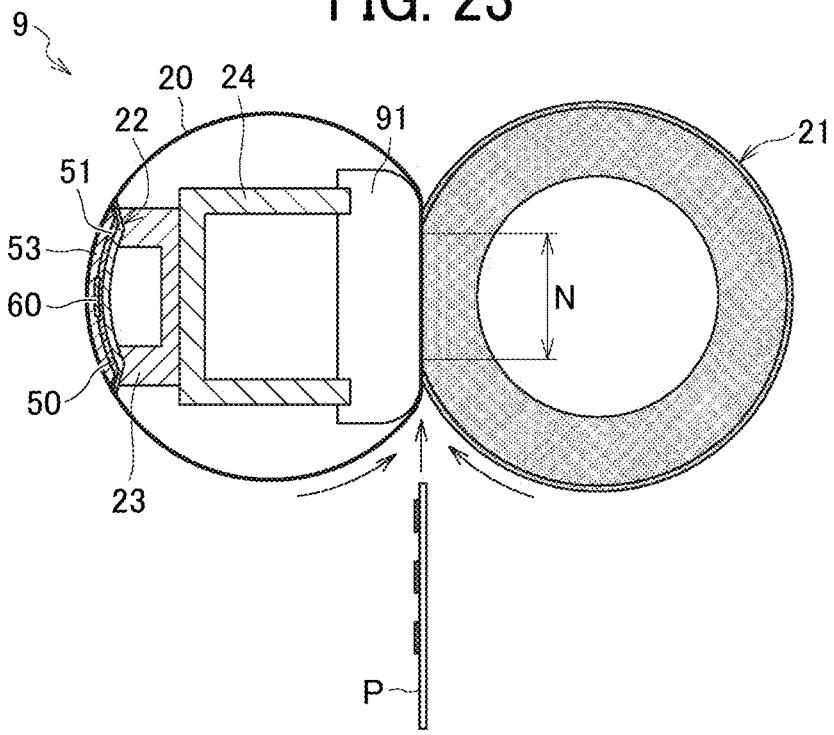
FIG. 23 is a schematic cross-sectional view of a configuration of a fixing device according to still another embodiment of the present disclosure.
Figure 24:
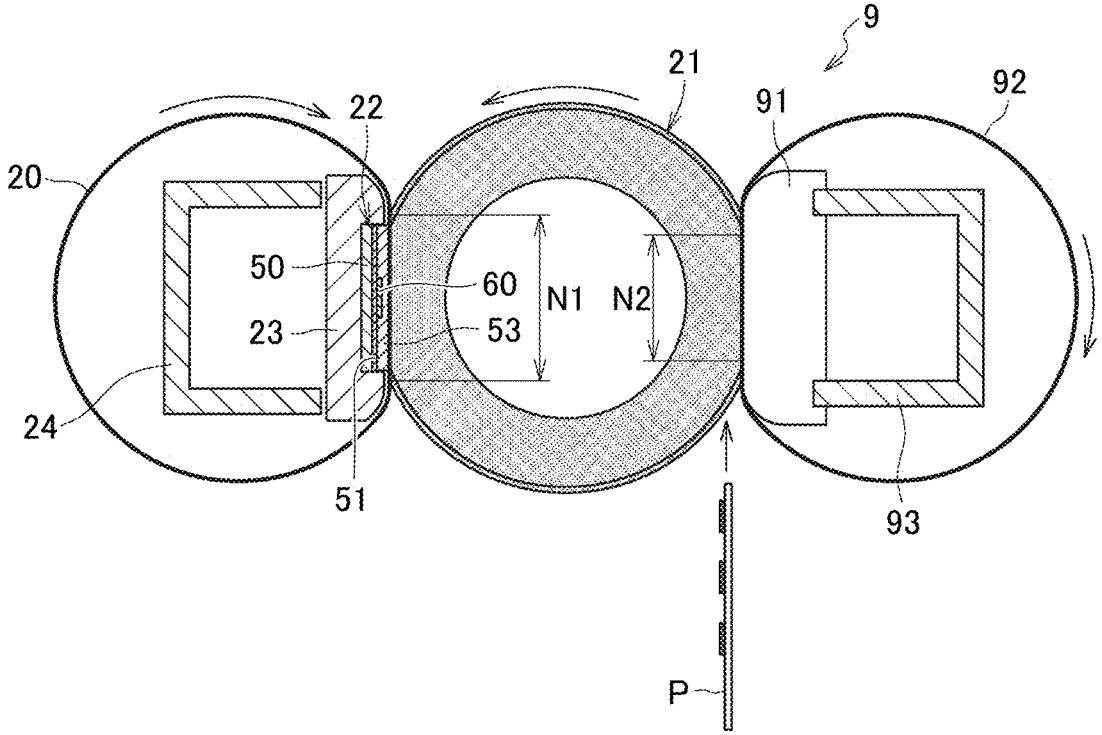
FIG. 24 is a schematic cross-sectional view illustrating a configuration of a fixing device according to still yet another embodiment of the present disclosure.

The fixing device disposed in the image forming apparatus is not limited to the above-described fixing device and may be the fixing device illustrated in FIGS. 22 to 24. The configurations of fixing devices illustrated in FIGS. 22 to 24 are briefly described below.

The fixing device 9 illustrated in FIG. 22 is different from the above-described fixing device in the point that the fixing device 9 illustrated in FIG. 22 includes a pressurization roller 90 opposite the pressure roller 21 with respect to the fixing belt 20. The fixing belt 20 is sandwiched by the pressurization roller 90 and the heater 22 and heated by the heater 22. On the other hand, a nip formation pad 91 serving as a nip former is disposed inside the loop formed by the fixing belt 20 and disposed opposite the pressure roller 21. The stay 24 supports the nip formation pad 91. The nip formation pad 91 and the pressure roller 21 sandwich the fixing belt 20 and define the fixing nip N.

Next, the fixing device 9 illustrated in FIG. 23 omits the above-described pressurization roller 90 and includes the heater 22 formed to be arc having a curvature of the fixing belt 20 to keep a circumferential contact length between the fixing belt 20 and the heater 22. Other parts of the fixing device 9 illustrated in FIG. 23 are the same as the fixing device 9 illustrated in FIG. 22.

Subsequently, the fixing device 9 illustrated in FIG. 24 includes a pressing belt 92 in addition to the fixing belt 20 and has a heating nip (a first nip) N1 and the fixing nip (a second nip) N1 separately. That is, the nip formation pad 91 and the stay 93 are disposed opposite the fixing belt 20 with respect to the pressure roller 21, and the pressing belt 92 is disposed to wrap around the nip formation pad 91 and the stay 93. Other construction of the fixing device is equivalent to that of the fixing device 9 depicted in FIG. 3.

Applying the present embodiments of the present disclosure to the image forming apparatus including one of the fixing devices as illustrated in FIGS. 22 to 24 described above can reduce the variation in the amounts of the protectant supplied to the image bearer, improve image quality, and is helpful for downsizing the image forming apparatus or increasing the print speed.

The above-described embodiments according to the present disclosure are applied to the image forming apparatus including the fixing device as one example of heating devices, but the present disclosure is not limited to this. The above-described embodiments according to the present disclosure may be applied to the image forming apparatus including a heating device to heat a sheet to perform a purpose other than fixing the image on the sheet.

The embodiments of the present disclosure have been described in detail above. The above-described embodiments are examples and can be modified within the scope not departing from the gist of the present disclosure. For example, any embodiment and any modification may be combined.

Numerous additional modifications and variations are possible in light of the above teachings. It is therefore to be understood that within the scope of the appended claims, the present disclosure may be practiced otherwise than as specifically described herein. The number, position, and shape of the components of the image forming apparatus described above are not limited to those described above.

What is claimed is:

1. An image forming apparatus comprising:

an image bearer configured to bear an image on a surface of the image bearer;

a protectant applicator configured to apply protectant to the surface of the image bearer;

a heating device including a heater, the heater including:

a base;

a heat generator;

an electrode; and a conductor coupling the heat generator to the electrode, the heater being configured to have a first position and a second position having a higher temperature than the first position, the first position and the second position being symmetrical to each other with respect to a center of a heat generation area of the heater in a longitudinal direction of the heater;

a first biasing member disposed at a position closer to the first position than the second position and configured to bias the protectant to the protectant applicator in a direction orthogonal to the axial direction of the protectant applicator with a first biasing force; and a second biasing member disposed at a position closer to the second position than the first position and configured to bias the protectant to the protectant applicator in a direction orthogonal to the axial direction of the protectant applicator with a second biasing force larger than the first biasing force.

2. The image forming apparatus according to claim 1, further comprising a driver disposed at a position closer to the second position than to the first position and configured to drive the image bearer.

3. The image forming apparatus according to claim 1, wherein the electrode includes a first electrode and a second electrode, and wherein the conductor includes a first conductor coupling a plurality first heat generators of the heat generator to the first electrode, a second conductor extending in a longitudinal direction of the base and coupling each of the plurality of first heat generators of the heat generator to the second electrode, and a third conductor including at least a part of a shunted current path in which current flows from the second conductor to the second electrode without passing through the first conductor.

4. The image forming apparatus according to claim 3,
wherein the shunted current path includes the third conductor, a third electrode that is different from the first electrode and the second electrode, and another heat generator coupling to the third electrode via the third conductor.

5. The image forming apparatus according to claim 1,
wherein a ratio of a dimension of the heat generator in a short-side direction to a dimension of the heater in the short-side direction is equal to or larger than 25% and less than 80%, and
wherein the short-side direction is a direction that intersects the longitudinal direction along a surface of the heater on which the heat generator is disposed.

6. The image forming apparatus according to claim 1,
wherein a ratio of a dimension of the heat generator in a short-side direction to a dimension of the heater in the short-side direction is equal to or larger than 40% and less than 80%, and
wherein the short-side direction is a direction that intersects the longitudinal direction along a surface of the heater on which the heat generator is disposed.

7. The image forming apparatus according to claim 1,
wherein the first and second biasing members are springs.

8. An image forming apparatus comprising:
an image bearer configured to bear an image on a surface of the image bearer;
a protectant applicator configured to apply protectant to the surface of the image bearer;
a heating device including a heater,
the heater including:
a base;
a heat generator;
an electrode; and
a conductor coupling the heat generator to the electrode, the heater configured to have a first position and a second position being symmetrical to each other with respect to a center of a heat generation area of the heater in a longitudinal direction of the heater,
wherein a sum of squares of currents passing through the second position is larger than a sum of squares of currents passing through the first position;
a first biasing member disposed at a position closer to the first position than the second position and configured to bias the protectant to the protectant applicator in a direction orthogonal to the axial direction of the protectant applicator with a biasing force; and
a second biasing member disposed at a position closer to the second position than the first position and configured to bias the protectant to the protectant applicator in a direction orthogonal to the axial direction of the protectant applicator with a second biasing force larger than the first biasing force.

9. The image forming apparatus according to claim 8,
a driver disposed at a position closer to the second position than to the first position and configured to drive the image bearer.

10. The image forming apparatus according to claim 8,
wherein the electrode includes a first electrode and a second electrode, and
wherein the conductor includes a first conductor coupling a plurality first heat generators of the heat generator to the first electrode, a second conductor extending in a longitudinal direction of the base and coupling each of the plurality of first hear generators of the heat generator to the second electrode, and a third conductor including at least a part of a shunted current path in which current flows from the second conductor to the second electrode without passing through the first conductor.

11. The image forming apparatus according to claim 10,
wherein the shunted current path includes the third conductor, a third electrode that is different from the first electrode and the second electrode, and another heat generator coupling to the third electrode via the third conductor.

12. The image forming apparatus according to claim 8,
wherein a ratio of a dimension of the heat generator in a short-side direction to a dimension of the heater in the short-side direction is equal to or larger than 25% and less than 80%, and
wherein the short-side direction is a direction that intersects the longitudinal direction along a surface of the heater on which the heat generator is disposed.

13. The image forming apparatus according to claim 8,
wherein a ratio of a dimension of the heat generator in a short-side direction to a dimension of the heater in the short-side direction is equal to or larger than 40% and less than 80%, and
wherein the short-side direction is a direction that intersects the longitudinal direction along a surface of the heater on which the heat generator is disposed.

14. The image forming apparatus according to claim 8,
wherein the first and second biasing members are springs.

* * * * *